US009895585B2

(12) United States Patent
Kroloff

(10) Patent No.: US 9,895,585 B2
(45) Date of Patent: Feb. 20, 2018

(54) GOLF CLUB HEADS AND METHODS TO MANUFACTURE GOLF CLUB HEADS

(71) Applicant: Parsons Xtreme Golf, LLC

(72) Inventor: Caleb S. Kroloff, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 15/352,846

(22) Filed: Nov. 16, 2016

(65) Prior Publication Data

US 2017/0361180 A1 Dec. 21, 2017

Related U.S. Application Data

(63) Continuation-in-part of application No. 29/575,219, filed on Aug. 23, 2016, which is a continuation-in-part of application No. 29/568,597, filed on Jun. 20, 2016, now abandoned, application No. 15/352,846, which is a continuation-in-part of application No. 29/582,093, filed on Oct. 25, 2016, which is a continuation-in-part of application No. 29/574,496, filed on Aug. 16, 2016, now abandoned.

(Continued)

(51) Int. Cl.
*A63B 53/04* (2015.01)
*A63B 53/06* (2015.01)

(52) U.S. Cl.
CPC .. *A63B 53/0487* (2013.01); *A63B 2053/0491* (2013.01)

(58) Field of Classification Search
USPC ..... 473/324–350
See application file for complete search history.

(56) References Cited

U.S. PATENT DOCUMENTS 922,444 A 5/1909 Youds
1,133,129 A * 3/1915 Govan ..... A63B 53/0466 473/337

(Continued)

FOREIGN PATENT DOCUMENTS

JP 08112380 A * 5/1996
JP 08238343 A * 9/1996 ..... A63B 53/0487

(Continued)

OTHER PUBLICATIONS

U.S. Appl. No. 29/523,587, Schweigert, "Golf Club Head," filed Apr. 10, 2015.

(Continued)

*Primary Examiner* — Alvin Hunter

(57) ABSTRACT

Embodiments of golf club heads and methods to manufacture golf club heads are generally described herein. In one example, a golf club head may include a body portion with a toe portion, a heel portion, a rear portion, a front portion with a strike face, a sole portion, and a top portion with a plurality of ports. The body portion may define a periphery of the golf club head, and a height of the body portion proximate to the toe portion may be greater than a height of the body portion proximate to the heel portion. The golf club head may also include a plurality of weight portions with each weight portion disposed in one port of the plurality of ports. Other examples and embodiments may be described and claimed.

20 Claims, 22 Drawing Sheets

Related U.S. Application Data

(60) Provisional application No. 62/353,524, filed on Jun. 22, 2016.

(56) References Cited

U.S. PATENT DOCUMENTS 1,518,316 A * 12/1924 Ellingham ..... A63B 53/0487 473/337
RE19,178 E * 5/1934 Spiker ..... A63B 53/0487 473/251
2,174,212 A * 9/1939 Newsome ..... A63B 53/0487 473/251
2,517,245 A * 8/1950 Scott ..... A63B 53/04 473/339
4,043,562 A 8/1977 Shillington
4,340,230 A * 7/1982 Churchward ..... A63B 53/04 473/339
4,730,830 A * 3/1988 Tilley ..... A63B 53/04 473/337
4,754,977 A * 7/1988 Sahm ..... A63B 53/04 473/337
4,869,507 A 9/1989 Sahm
D335,317 S 5/1993 Shearer
D335,692 S 5/1993 Antonious
D336,757 S 6/1993 Antonious
5,340,107 A * 8/1994 Baker ..... A63B 53/0487 273/DIG. 23
D350,582 S 9/1994 Miansian et al.
5,385,348 A * 1/1995 Wargo ..... A63B 53/08 473/291
5,429,366 A 7/1995 McCabe
D363,101 S 10/1995 Sturm
D365,864 S 1/1996 Sturm
5,489,097 A * 2/1996 Simmons ..... A63B 53/0487 473/326
D368,751 S 4/1996 Rife
D369,393 S 4/1996 Takahashi et al.
5,533,725 A * 7/1996 Reynolds, Jr. ..... A63B 53/02 473/307
5,571,053 A 11/1996 Lane
5,603,666 A * 2/1997 Bowe ..... A63B 53/02 473/307
D378,688 S 4/1997 Cameron
D385,609 S 10/1997 Cameron
5,683,307 A 11/1997 Rife
D388,143 S 12/1997 Huan-Chiang
D389,207 S 1/1998 Cameron
5,746,664 A * 5/1998 Reynolds, Jr. ..... A63B 53/02 473/252
D398,685 S 9/1998 Masuda
D399,290 S 10/1998 Sizemore, Jr.
D399,911 S 10/1998 Nicolette et al.
5,839,974 A 11/1998 McAllister
D405,836 S 2/1999 Nicolette et al.
D409,701 S 5/1999 Ashcraft et al.
5,924,938 A * 7/1999 Hines ..... A63B 53/02 473/307
D422,655 S 4/2000 Hicks
D426,276 S 6/2000 Besnard et al.
6,077,171 A * 6/2000 Yoneyama ..... A63B 53/04 473/291
D431,854 S 10/2000 Cameron
D432,192 S 10/2000 Hicks
D436,151 S 1/2001 Nicolette et al.
D437,374 S 2/2001 Cameron
D441,820 S 5/2001 Nicolette et al.
D443,668 S 6/2001 Nicolette et al.
D443,905 S 6/2001 Nicolette et al.
D444,833 S 7/2001 Wells et al.
6,264,571 B1 7/2001 Lekavich
6,290,609 B1 * 9/2001 Takeda ..... A63B 53/047 473/335
D449,664 S 10/2001 Beebe et al.
D449,865 S 10/2001 Fife et al.
D450,799 S 11/2001 Nicolette et al.
D451,973 S 12/2001 Wells et al.
6,348,014 B1 * 2/2002 Chiu ..... A63B 53/065 473/337
6,354,959 B1 3/2002 Nicolette et al.
6,394,910 B1 * 5/2002 McCarthy ..... A63B 53/0487 473/251
6,450,894 B1 9/2002 Sun et al.
D472,949 S 4/2003 Serrano
D474,821 S 5/2003 Wells et al.
6,592,467 B1 * 7/2003 Gray ..... A63B 53/0487 473/332
D483,086 S 12/2003 Schweigert et al.
D486,872 S 2/2004 Schweigert et al.
6,702,689 B2 * 3/2004 Ashton ..... A63B 53/0487 473/251
D498,276 S 11/2004 Schweigert et al.
6,896,625 B2 * 5/2005 Grace ..... A63B 53/0487 473/251
6,902,496 B2 6/2005 Solheim et al.
D512,116 S 11/2005 Miraflor et al.
D513,776 S * 1/2006 Grace ..... D21/736
6,988,956 B2 1/2006 Cover et al.
D520,088 S 5/2006 Parr
D531,242 S 10/2006 Adams
D532,067 S 11/2006 Soracco et al.
7,153,220 B2 12/2006 Lo
D534,595 S 1/2007 Hasebe
7,156,752 B1 1/2007 Bennett
D536,401 S 2/2007 Kawami
D536,403 S 2/2007 Kawami
D538,371 S 3/2007 Kawami
7,204,765 B2 4/2007 Cover et al.
D542,869 S 5/2007 Adams
D543,252 S * 5/2007 Haggstrom ..... D21/736
D543,598 S 5/2007 Kuan et al.
D543,601 S 5/2007 Kawami
D555,219 S 11/2007 Lin
D556,277 S 11/2007 Broom
7,309,297 B1 * 12/2007 Solari ..... A63B 53/04 473/256
D561,854 S 2/2008 Morris
7,331,876 B2 2/2008 Klein
7,351,162 B2 4/2008 Soracco et al.
7,354,355 B2 * 4/2008 Tavares ..... A63B 53/04 473/329
D569,461 S 5/2008 Morris
D569,930 S 5/2008 Nehrbas
7,396,289 B2 7/2008 Soracco et al.
D577,085 S 9/2008 Nicolette et al.
D577,086 S 9/2008 Nicolette et al.
D579,506 S 10/2008 Nicolette et al.
D579,995 S 11/2008 Nicolette et al.
D582,497 S 12/2008 Rollinson
7,473,189 B2 1/2009 Schweigert et al.
7,491,131 B2 2/2009 Vinton
D599,425 S 9/2009 Laub
D600,763 S 9/2009 Cameron
7,744,485 B2 6/2010 Jones et al.
D620,993 S 8/2010 Laub
D623,709 S 9/2010 Serrano et al.
D631,925 S 2/2011 Broom
7,887,432 B2 2/2011 Jones et al.
7,909,707 B2 3/2011 Klein
7,918,745 B2 4/2011 Morris et al.
D638,891 S 5/2011 Nicolette et al.
D642,643 S 8/2011 Nicolette et al.
D643,485 S 8/2011 Nicolette et al.
D645,104 S 9/2011 Nicolette et al.
8,096,039 B2 1/2012 Soracco et al.
D653,718 S 2/2012 Stokke et al.
D661,753 S 6/2012 Cameron et al.
D666,260 S 8/2012 Cynn
8,376,878 B2 2/2013 Bennett et al.
8,382,604 B2 2/2013 Billings
8,414,422 B2 * 4/2013 Peralta ..... A63B 53/0466 473/334
D688,339 S 8/2013 Hilton et al.

(56) References Cited

U.S. PATENT DOCUMENTS

| | | | | |
|---|---|---|---|---|
| D688,341 | S | 8/2013 | Rollinson | |
| D691,226 | S | 8/2013 | Hilton et al. | |
| D699,308 | S | 2/2014 | Rollinson | |
| D704,782 | S | 5/2014 | Rollinson | |
| 8,721,472 | B2 | 5/2014 | Kuan et al. | |
| 8,790,193 | B2 | 7/2014 | Serrano et al. | |
| D711,483 | S | 8/2014 | Wong | |
| D722,350 | S | 2/2015 | Schweigert | |
| D722,351 | S * | 2/2015 | Parsons | D21/736 |
| D722,352 | S | 2/2015 | Nicolette et al. | |
| D723,120 | S | 2/2015 | Nicolette | |
| 8,961,336 | B1 * | 2/2015 | Parsons | A63B 53/0475 473/332 |
| D724,164 | S | 3/2015 | Schweigert et al. | |
| D725,208 | S | 3/2015 | Schweigert | |
| D726,265 | S | 4/2015 | Nicolette | |
| D726,846 | S | 4/2015 | Schweigert | |
| D733,234 | S | 6/2015 | Nicolette | |
| D738,447 | S | 9/2015 | Schweigert | |
| D738,449 | S | 9/2015 | Schweigert | |
| D739,487 | S | 9/2015 | Schweigert | |
| D741,426 | S | 10/2015 | Schweigert | |
| 9,192,830 | B2 * | 11/2015 | Parsons | A63B 53/0475 |
| 9,199,140 | B1 * | 12/2015 | Schweigert | A63B 53/0466 |
| D748,213 | S | 1/2016 | Parsons et al. | |
| D748,215 | S | 1/2016 | Parsons et al. | |
| D753,252 | S | 4/2016 | Schweigert | |
| 9,346,203 | B2 * | 5/2016 | Parsons | B29C 45/14467 |
| 9,364,727 | B2 * | 6/2016 | Parsons | A63B 53/0475 |
| 9,468,821 | B2 * | 10/2016 | Parsons | A63B 53/0466 |
| 9,533,201 | B2 * | 1/2017 | Parsons | A63B 53/0475 |
| 9,550,096 | B2 * | 1/2017 | Parsons | A63B 53/0466 |
| 9,555,295 | B2 * | 1/2017 | Schweigert | A63B 53/0466 |
| 9,610,481 | B2 * | 4/2017 | Parsons | A63B 53/04 |
| 9,630,070 | B2 * | 4/2017 | Parsons | A63B 53/0466 |
| 9,649,540 | B2 * | 5/2017 | Parsons | A63B 53/04 |
| 9,649,542 | B2 * | 5/2017 | Nicolette | A63B 53/0475 |
| 9,662,547 | B2 * | 5/2017 | Parsons | A63B 53/0466 |
| 9,675,853 | B2 * | 6/2017 | Parsons | A63B 53/0475 |
| 2004/0038746 | A1 | 2/2004 | Wahl et al. | |
| 2005/0049076 | A1 | 3/2005 | Schweigert et al. | |
| 2007/0142122 | A1 | 6/2007 | Bonneau | |
| 2007/0207875 | A1 | 9/2007 | Kuan et al. | |
| 2007/0238548 | A1 | 10/2007 | Johnson | |
| 2008/0139333 | A1 | 6/2008 | Klein | |
| 2008/0146372 | A1 | 6/2008 | John | |
| 2008/0176672 | A1 | 7/2008 | Roach et al. | |
| 2011/0165959 | A1 | 7/2011 | Klein | |
| 2013/0165256 | A1 | 6/2013 | Stevenson | |
| 2013/0210537 | A1 | 8/2013 | Ainscough et al. | |
| 2015/0306476 | A1 * | 10/2015 | Schweigert | A63B 53/0487 473/251 |
| 2015/0306477 | A1 * | 10/2015 | Parsons | A63B 53/065 473/251 |
| 2016/0030816 | A1 * | 2/2016 | Schweigert | A63B 53/0487 473/339 |
| 2016/0051871 | A1 * | 2/2016 | Parsons | A63B 53/0487 473/335 |
| 2016/0089582 | A1 * | 3/2016 | Schweigert | A63B 53/0487 473/231 |
| 2016/0199703 | A1 * | 7/2016 | Parsons | A63B 53/0487 473/335 |
| 2016/0250526 | A1 * | 9/2016 | Parsons | A63B 53/0487 473/257 |
| 2016/0296811 | A1 * | 10/2016 | Schweigert | A63B 53/0487 |
| 2017/0216690 | A1 * | 8/2017 | Parsons | A63B 53/065 |

FOREIGN PATENT DOCUMENTS

| | | | | |
|---|---|---|---|---|
| JP | 09308717 | A * | 12/1997 | A63B 53/04 |
| JP | 10277187 | A * | 10/1998 | |
| JP | 11155985 | A * | 6/1999 | |
| JP | 2001025518 | A * | 1/2001 | |
| JP | 2001137400 | A * | 5/2001 | |
| JP | 2001346924 | A * | 12/2001 | |
| JP | 2004159680 | A * | 6/2004 | |
| JP | 2005/160691 | A | 6/2005 | |
| JP | 2005287679 | A * | 10/2005 | |
| JP | 2006187489 | A * | 7/2006 | |
| JP | 2007222257 | A * | 9/2007 | |
| JP | 2010259578 | A * | 11/2010 | |
| JP | 2015051254 | A * | 3/2015 | |

OTHER PUBLICATIONS

TourSpecGolf (Gold's Factory Multi Weigted Custom Putter) [online]. Nov. 20, 2010 [retrieved Jul. 7, 2015]. Retrieved from the internet: <URL: http://www.tourspecgolf.com/blog/golds-factory-multi-weighted-custom-putter/>.

International Search Report and Written Opinion issued in connection with corresponding application No. PCT/US15/27841 dated Jul. 30, 2015 (14 pages).

International Search Report and Written Opinion issued in connection with corresponding application No. PCT/US17/28775, dated Jul. 5, 2017 (9 pages).

* cited by examiner

GOLF CLUB HEADS AND METHODS TO MANUFACTURE GOLF CLUB HEADS

CROSS REFERENCE

This application claims the benefit of U.S. Provisional Application Ser. No. 62/353,524, filed on Jun. 22, 2016. This application is a continuation-in-part application of U.S. application Ser. No. 29/575,219, filed Aug. 23, 2016, which is a continuation-in-part application of U.S. application Ser. No. 29/568,597, filed Jun. 20, 2016. This application is a continuation-in-part application of U.S. application Ser. No. 29/582,093, filed Oct. 25, 2016, which is a continuation-in-part application of U.S. application Ser. No. 29/574,496, filed Aug. 16, 2016.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Proper alignment of a golf club head at an address position relative to a golf ball may improve the performance of an individual. Various alignment aids have been used on the golf club heads to improve the individual's visual alignment.

Figure 1:
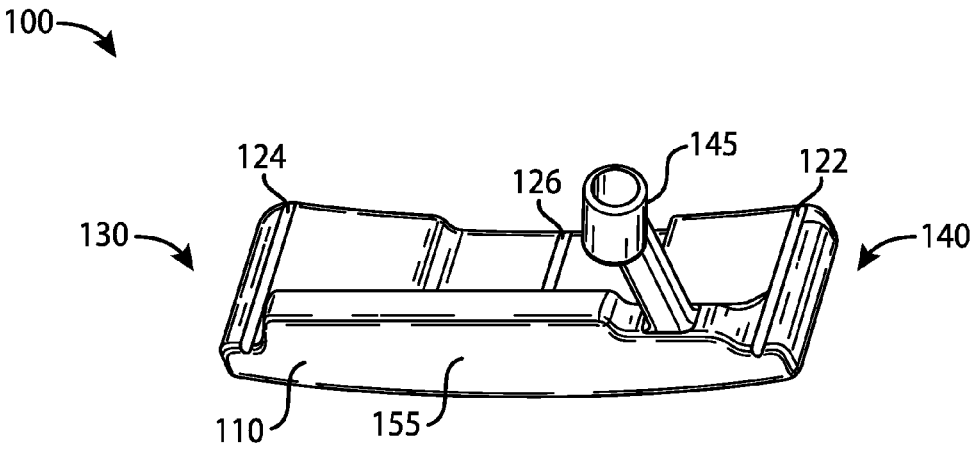
FIG. 1 depicts a front perspective view of a golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

In the example of FIGS. 1-10, a golf club head 100 may include a body portion 110, and a visual guide portion 120, generally shown 122, 124, and 126. The body portion 110 may include a toe portion 130, a heel portion 140, a front portion 150, a rear portion 160, a top portion 170, and a sole portion 180. The body portion 110 may be manufactured via various manufacturing methods and/or processes (e.g., a casting process, a forging process, a milling process, a cutting process, a grinding process, a welding process, a combination thereof, etc.). The body portion 110 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 110 may be partially or entirely made of non-metal material (e.g., composite, plastic, etc.). The golf club head 100 may be a putter-type golf club head (e.g., a blade-type putter, a mid-mallet-type putter, a mallet-type putter, etc.). Based on the type of putter as mentioned above, the body portion 110 may be at least 200 grams. For example, the body portion 110 may be in a range between 300 to 600 grams. Although FIGS. 1-10 may depict a particular type of club head, the apparatus, methods, and articles of manufacture described herein may be applicable to other types of club heads (e.g., a driver-type club head, a fairway wood-type club head, a hybrid-type club head, an iron-type golf club head, etc.). The apparatus, methods, and articles of manufacture described herein are not limited in this regard.

The toe and heel portions 130 and 140, respectively, may be on opposite ends of the body portion 110. The heel portion 140 may include a hosel portion 145 configured to receive a shaft (not shown) with a grip (not shown) on one end and the golf club head 100 on the opposite end of the shaft to form a golf club. Alternatively, the heel portion 140 may include a bore portion to receive the shaft (one shown as 1245 in FIGS. 11-13). The toe and heel portions 130 and 140, respectively, may define a width of the body portion 110.

In a similar manner, the front and rear portions 150 and 160, respectively, may be on opposite ends of the body portion 110. The front portion 150 may include a face portion 155 (e.g., a strike face). The face portion 155 may be used to impact a golf ball (one shown as 500 in FIG. 5). The face portion 155 may be an integral portion of the body portion 110. Alternatively, the face portion 155 may be a separate piece or an insert coupled to the body portion 110 via various manufacturing methods and/or processes (e.g., a bonding process, a welding process, a brazing process, a mechanical locking method, a mechanical fastening method, any combination thereof, or other suitable types of manufacturing methods and/or processes). The face portion 155 may be associated with a loft plane that defines the loft angle of the golf club head 100. The front and rear portions 150 and 160, respectively, may define a length of the body portion 110 (shown as 920 in FIG. 9). The apparatus, methods, and articles of manufacture described herein are not limited in this regard.

In one example, the visual guide portion 120 may include a first guide portion 122, and a second guide portion 124. The first and second guide portions 122 and 124, respectively, may extend between the front and rear portions 150 and 160, respectively. For example, the first and second guide portions 122 and 124, respectively, may extend the length of the body portion 110. The first and second guide portions 122 and 124, respectively, may be substantially congruent (e.g., same length). Alternatively, the first and second guide portions 122 and 124, respectively, may have different lengths. That is, the first guide portion 122 may be longer than the second guide portion 124 or vice versa. The apparatus, methods, and articles of manufacture described herein are not limited in this regard.

The visual guide portion 120 may include a solid line portion, a dashed line portion, a dotted line portion, or any combination thereof. As shown in the figures, for example, the first and second guide portions 122 and 124, respectively, may be solid line portions. The visual guide portion 120 may include a colored line portion, a raised line portion, a recessed line portion, a laser-etched line portion, or any combination thereof. For example, the first and second guide portions 122 and 124, respectively, may be colored and recessed line portions (e.g., including a contrast layer relative to the body portion 110). The first and second guide portions 122 and 124, respectively, may be the same color, which may be different than the color of the body portion 110 (e.g., two contrasting colors). For example, the first and second guide portions 122 and 124, respectively, may be a white color whereas the body portion 110 may be a black color (e.g., a black-nickel chrome). Alternatively, the body portion 110 and/or the visual guide portions 120 may be manufactured with different methods and/or processes so that the body portion 110 and the visual guide portion 120 may have contrasting finishes. For example, the body portion 110 may have a black-nickel chrome finish whereas the first and second guide portions 122 and 124, respectively, may have a stainless-steel finish. While the above examples may describe the first and second guide portions 122 and 124, respectively, having the same color, the first and second guide portions 122 and 124, respectively, may have different colors. The apparatus, methods, and articles of manufacture described herein are not limited in this regard.

Further, the first and second guide portions 122 and 124, respectively, may be substantially parallel to each other. The first and second guide portions 122 and 124, respectively, may be separated by at least 1.68 inches. The first guide portion 122 may be located at or proximate to the toe portion 130 whereas the second guide portion 124 may be located at or proximate to the heel portion 140. For example, the first guide portion 122 may be located less than one inch from an outer edge of the toe portion 130 whereas the second guide portion 124 may be located less than one inch from an outer edge of the heel portion 140. In particular, the toe portion 130 may be associated with a toe end point 135, and the heel portion 140 may be associated with a heel end point 145.

Figure 2:
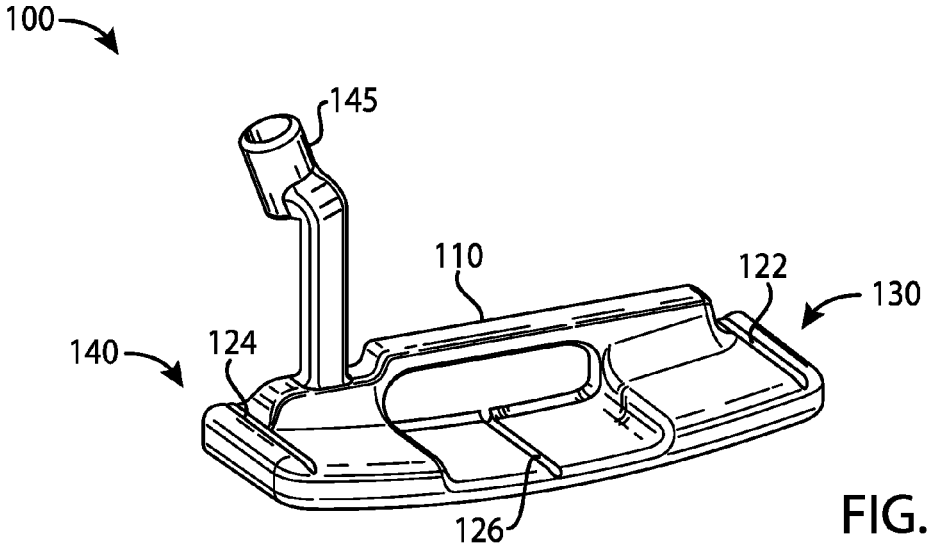
FIG. 2 depicts a rear perspective view of the example golf club head of FIG. 1.
Figure 3:
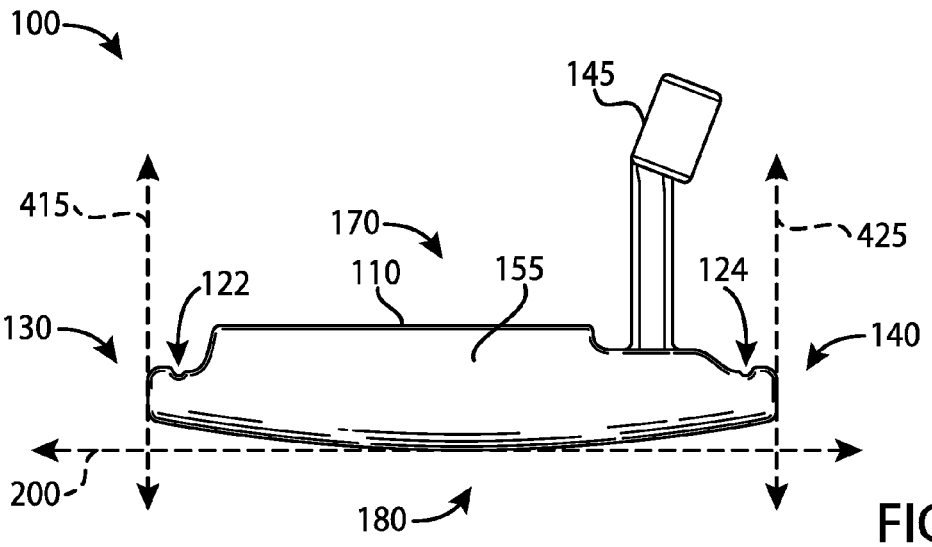
FIG. 3 depicts a front view of the example golf club head of FIG. 1.
Figure 4:
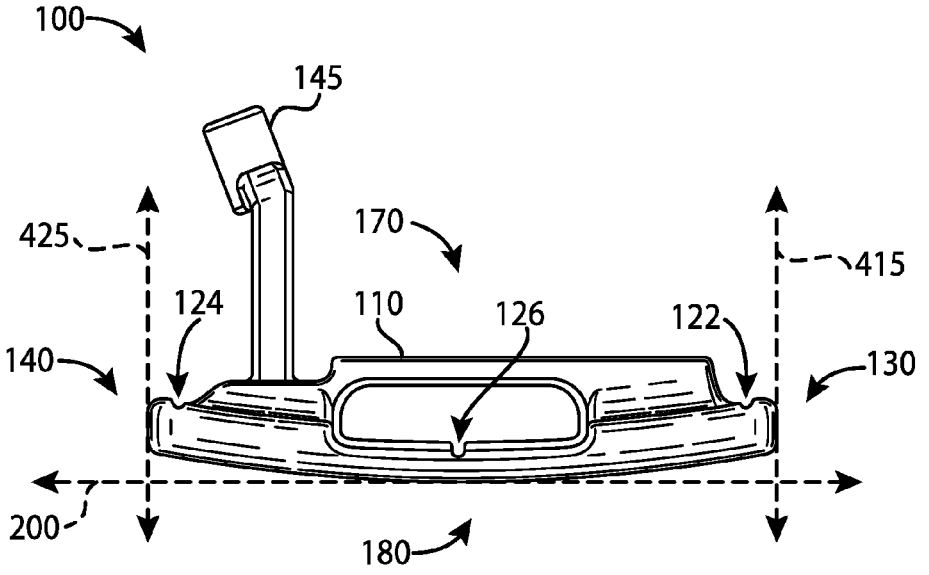
FIG. 4 depicts a rear view of the example golf club head of FIG. 1.

The toe end point 135 may be tangential to a first vertical plane 415 (FIG. 4), and the heel end point 145 may be tangential to a second vertical plane 425 (FIG. 4). The first and second vertical planes 415 and 425, respectively, may be substantially parallel to each other and substantially perpendicular to a ground plane 200 (FIGS. 2 and 3). In one example, the first guide portion 122 may be located on the toe portion 130 less than one inch from the first vertical plane 415, and the second guide portion 124 may be located on the heel portion 140 less than one inch from the second vertical plane 425. Alternatively, the first and second guide portions 122 and 124, respectively, may be located at different distances from the first and second vertical planes 415 and 425, respectively. For example, the first guide portion 122 may be located 0.5 inch (12.7 mm) from the first vertical plane 415 whereas the second guide portion 124 may be located at 0.75 inch from the second vertical plane 425. The apparatus, methods, and articles of manufacture described herein are not limited in this regard.

Figure 9:
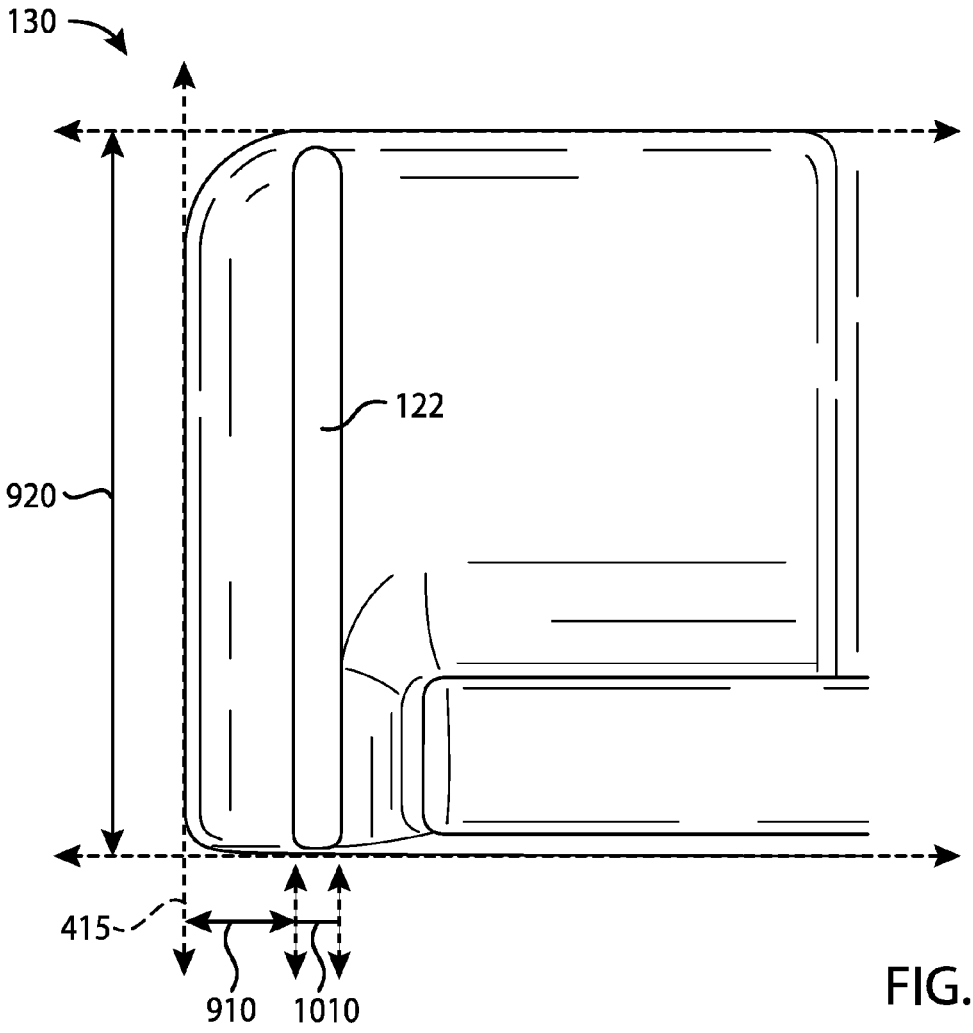
FIG. 9 depicts an exploded view of an example toe portion of the example golf club head of FIG. 1.
Figure 10:
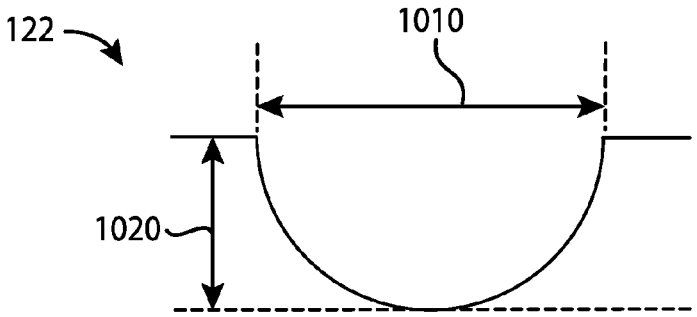
FIG. 10 depicts an exploded view of an example visual guide portion of the example golf club head of FIG. 1.

As mentioned above, the first and second guide portions 122 and 124, respectively, may be recessed line portions. For example, the first and second guide portions 122 and 124, respectively, may have a U-like cross-section shape. Alternatively, the first and second guide portions 122 and 124, respectively, may have a V-like cross-section shape or any other suitable cross-section shape. Turning to FIGS. 9 and 10, for example, the first guide portion 122 may be located a distance 910 from the first vertical plane 415. The distance 910 may be less than one inch. The first guide portion 122 may have a length 920 of at least 0.5 inch (12.7 mm). In particular, the length 920 may be about 1.6 inch. Further, the first guide portion 122 may have a width 1010 of at least 0.05 inch, and a depth 1020 of at least 0.015 inch. In one example, the width 1010 may be about 0.1 inch, and the depth 1020 may be about 0.05 inch. The apparatus, methods, and articles of manufacture described herein are not limited in this regard.

Figure 5:
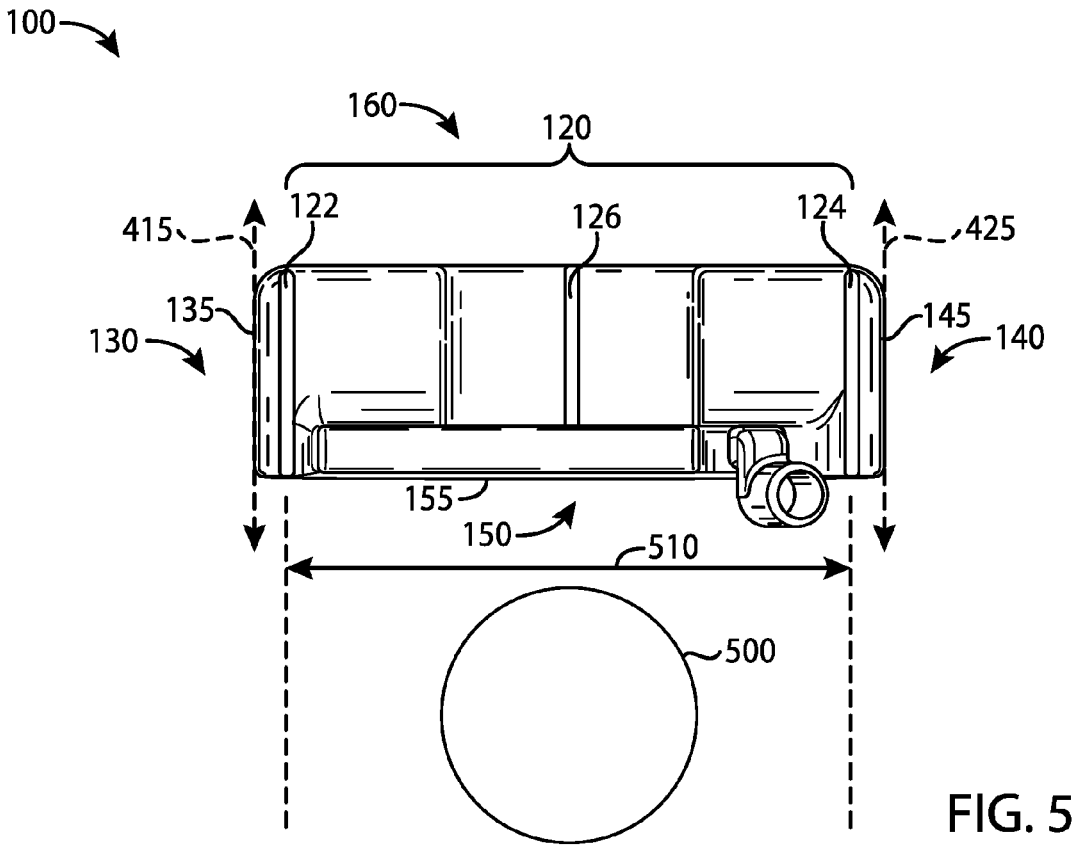
FIG. 5 depicts a top view of the example golf club head of FIG. 1.
Figure 6:
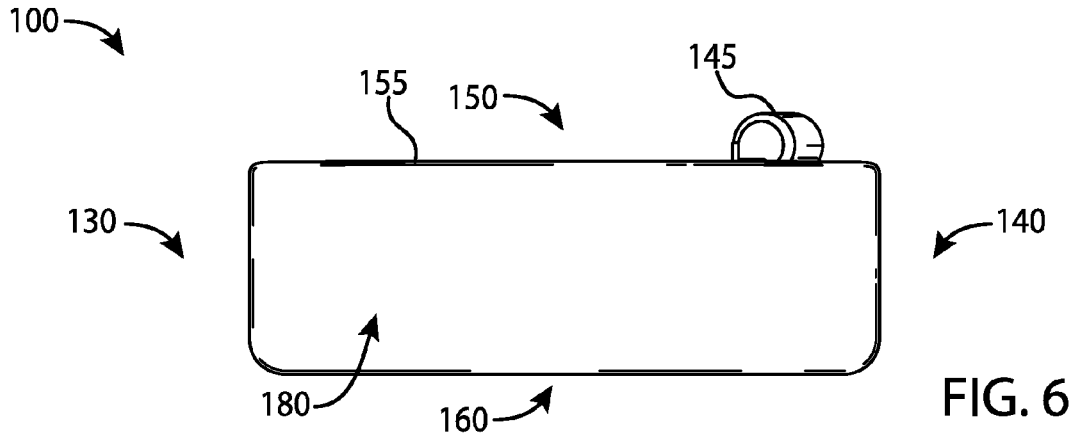
FIG. 6 depicts a bottom view of the example golf club head of FIG. 1.
Figure 7:
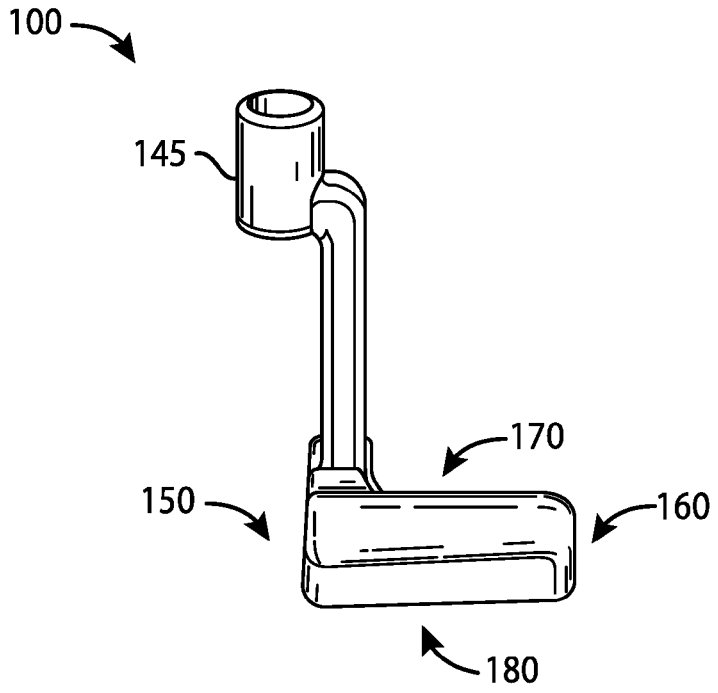
FIG. 7 depicts a left view of the example golf club head of FIG. 1.
Figure 8:
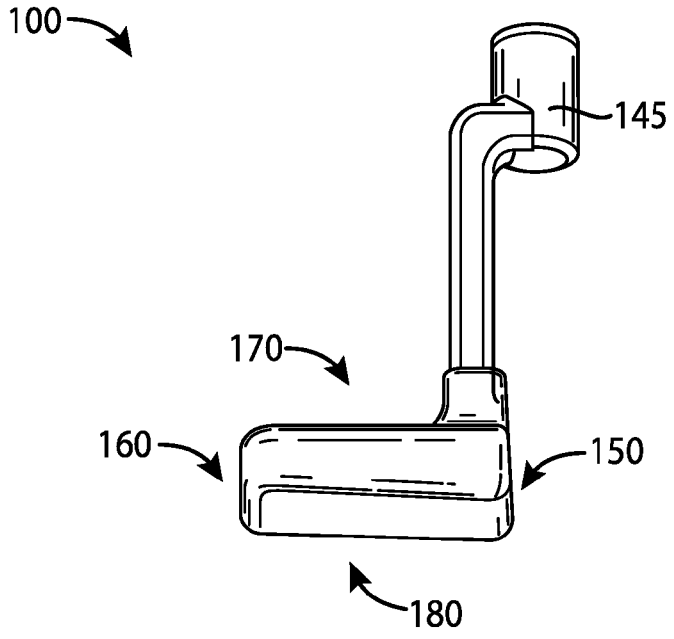
FIG. 8 depicts a right view of the example golf club head of FIG. 1.
Figure 11:
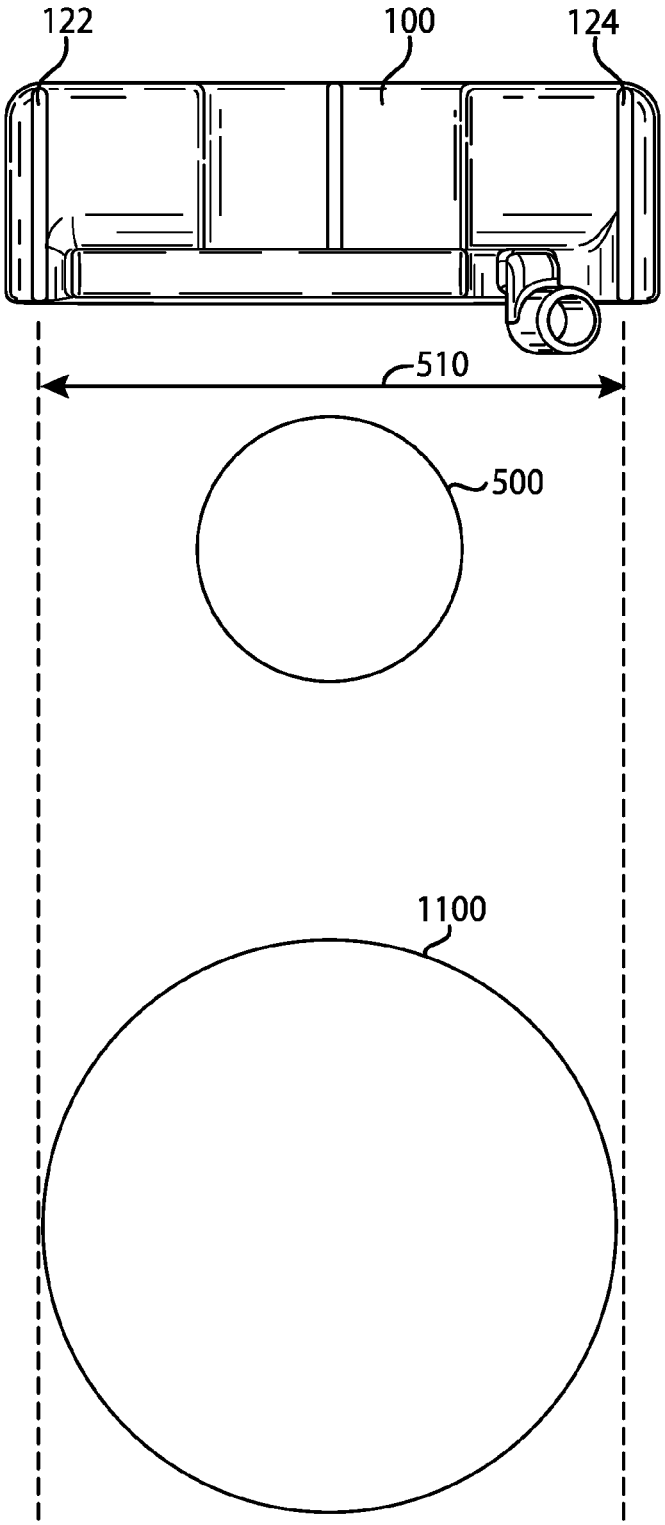
FIG. 11 depicts an example golf hole relative to the example golf club head of FIG. 1.

As with other alignment aids, the visual guide portion 120 may help with visual alignment. In contrast to other alignment aids, however, the visual guide portion 120 may help an individual to visualize a golf ball relative to a golf hole or cup. As illustrated in FIGS. 5 and 11, for example, a distance 510 may separate the first and second guide portions 122 and 124, respectively. In particular, the distance 510 may be greater than a diameter of a golf ball 500 (e.g., 1.68 inches or 42.67 millimeters). For example, the distance 510 may be greater than a diameter of a golf cup 1100 (e.g., 4.25 inches or 107.95 millimeters). By providing a mental image of the golf ball 500 being relatively smaller than the golf cup 1100 (i.e., the golf ball 500 may be less than 40% of the golf cup 1100), the first and second guide portions 122 and 124, respectively, may help build an individual's confidence and ability to putt. Alternatively, the distance 510 may be less than or equal to 4.25 inches but greater than 1.68 inches to provide a mental image of the golf ball 500 being relatively smaller than the golf cup 1100. The apparatus, methods, and articles of manufacture described herein are not limited in this regard.

The visual guide portion 120 may also include a third guide portion 126. The third guide portion 126 may bisect the body portion 110. In one example, the third guide portion 126 may be substantially equidistant from the first and second guide portions 122 and 124, respectively. The third guide portion 126 may be the same as or different from the first and/or second guide portions 122 and 124, respectively. In one example, the first, second, and third guide portions 122, 124, and 126, respectively, may be recessed line portions with the same color. Alternatively, the first and second guide portions 122 and 124, respectively, may be recessed guide portions whereas the third guide portion 126 may be a raised line portion. In another example, the third guide portion 126 may be a different color than the first and second guide portions 122 and 124, respectively. In yet another example, the third guide portion 126 may have a different length than the first and second guide portions 122 and 124. The apparatus, methods, and articles of manufacture described herein are not limited in this regard.

Figure 12:
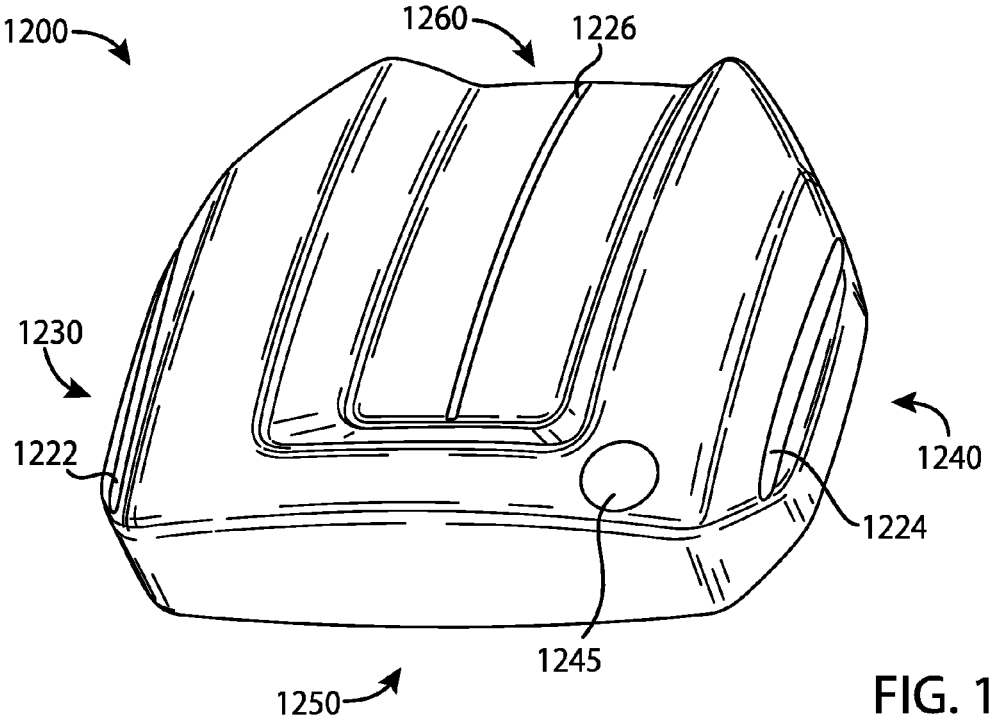
FIG. 12 depicts a front perspective view of a golf club head according to another embodiment of the apparatus, methods, and articles of manufacture described herein.
Figure 13:
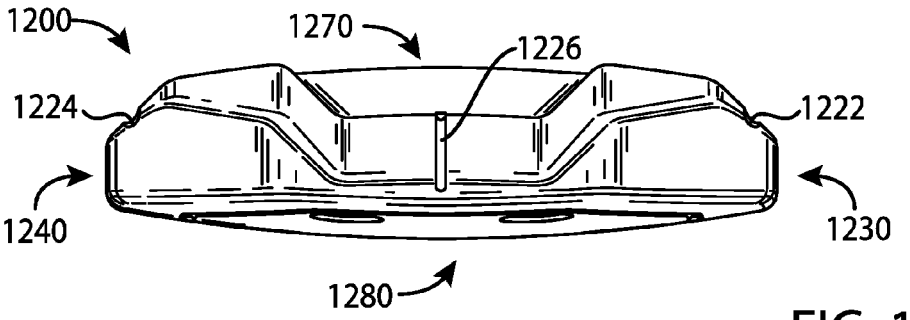
FIG. 13 depicts a rear perspective view of the example golf club head of FIG. 11.
Figure 14:
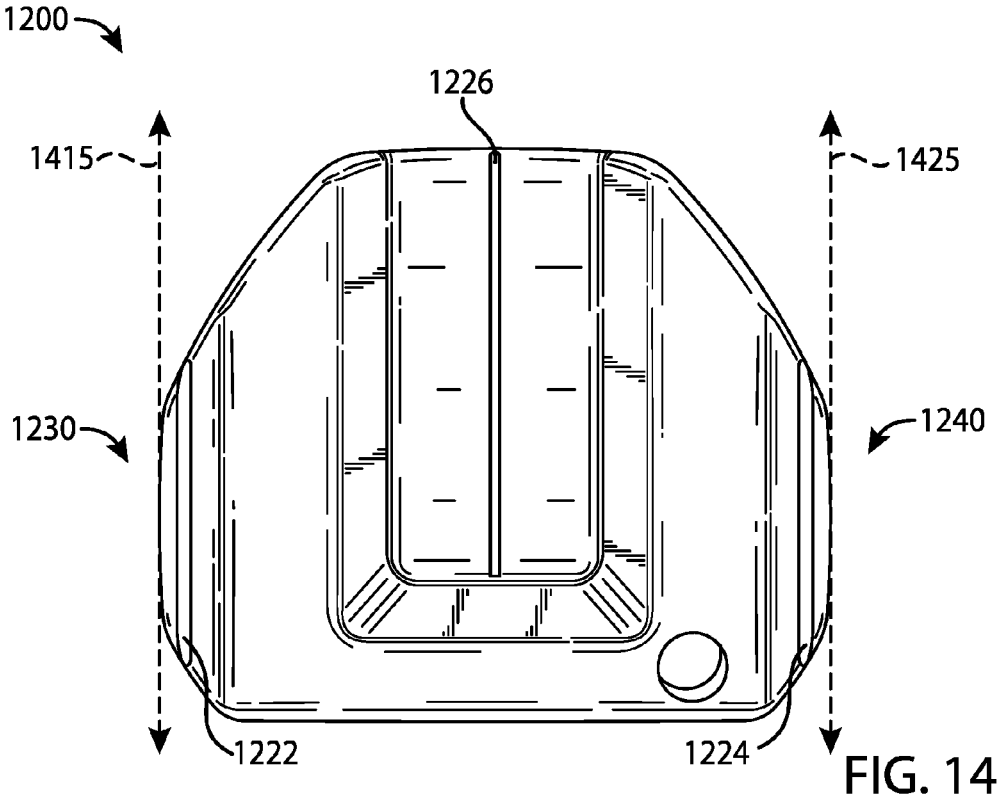
FIG. 14 depicts a top view of the example golf club head of FIG. 11.

Referring to FIGS. 12-14, for example, a golf club head 1200 may include a body portion 1210, and a visual guide portion 1220, generally shown 1222, 1224, and 1226. The body portion 1210 may include a toe portion 1230, a heel portion 1240, a front portion 1250, a rear portion 1260, a top portion 1270, and a sole portion 1280. Instead of a hosel, the golf club head 1200 may include a bore 1245 to receive a shaft (not shown). In a similar manner to the visual guide portions 122 and 124 (FIGS. 1-11), the visual guide portions 1222 and 1224 may be located a particular distance from a first vertical plane 1415 and a second vertical plane 1425, respectively. For example, the visual guide portion 1222 may be located less than one inch from the first vertical plane 1415 and the visual guide portion 1224 may be located less than one inch from the second vertical plane 1425. Further, a distance may be separate the visual guide portions 1222 and 1224, which may be greater than a diameter of a golf ball. The apparatus, methods, and articles of manufacture described herein are not limited in this regard.

Figure 15:
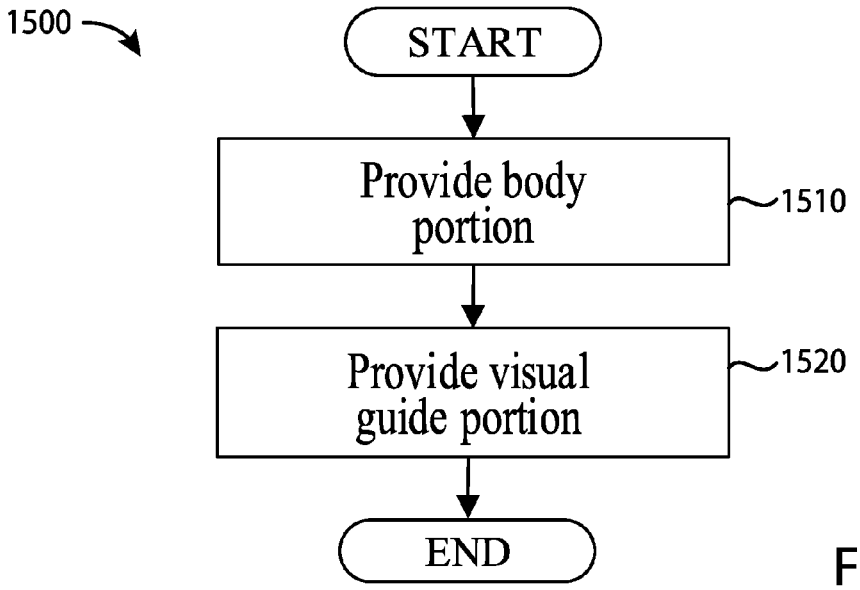
FIG. 15 depicts one manner in which the example golf club heads described herein may be manufactured.
Figure 16:
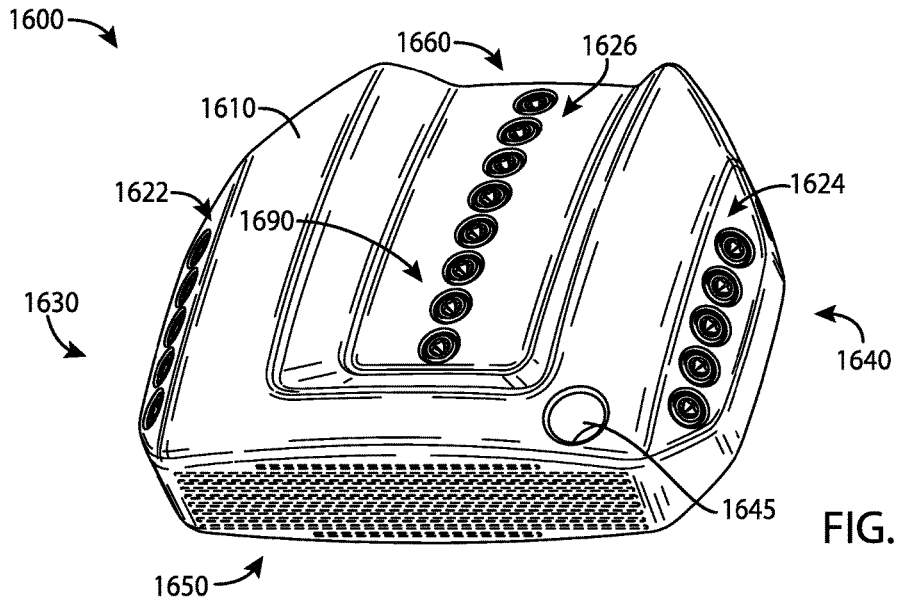
FIG. 16 depicts a front perspective view of a golf club head according to yet another embodiment of the apparatus, methods, and articles of manufacture described herein.
Figure 17:
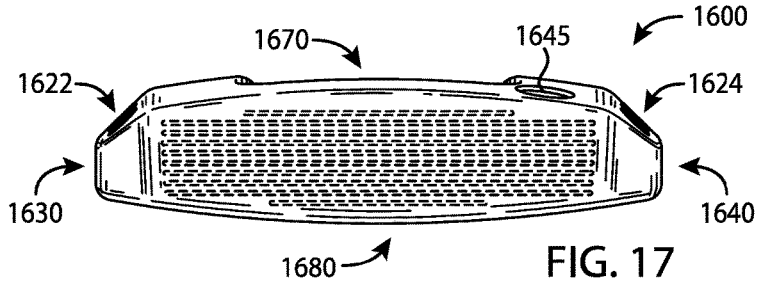
FIG. 17 depicts a front view of the example golf club head of FIG. 16.
Figure 18:
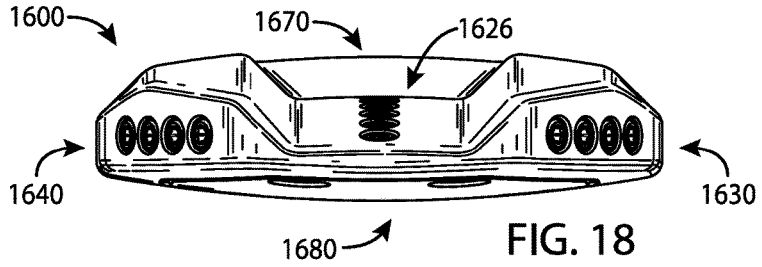
FIG. 18 depicts a rear view of the example golf club head of FIG. 16.
Figure 19:
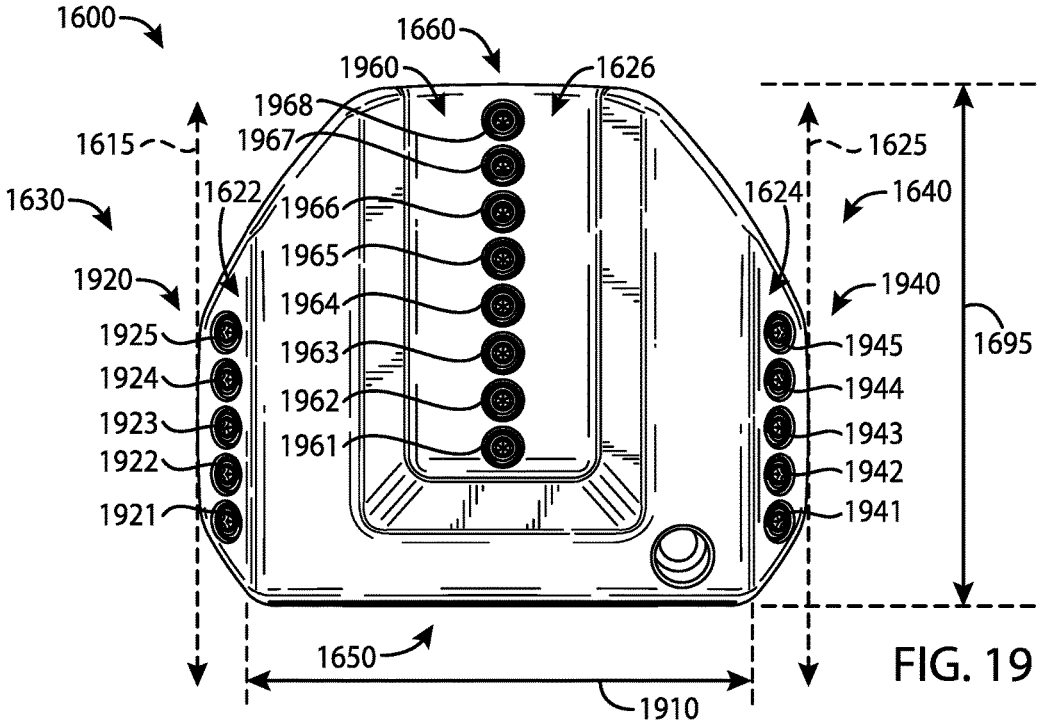
FIG. 19 depicts a top view of the example golf club head of FIG. 16.
Figure 20:
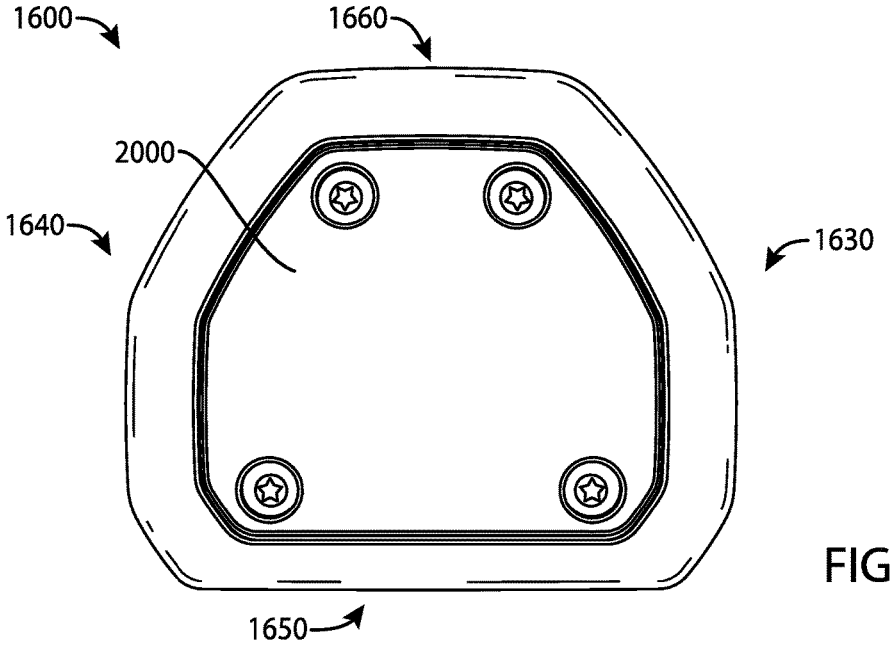
FIG. 20 depicts a bottom view of the example golf club head of FIG. 16.
Figure 21:
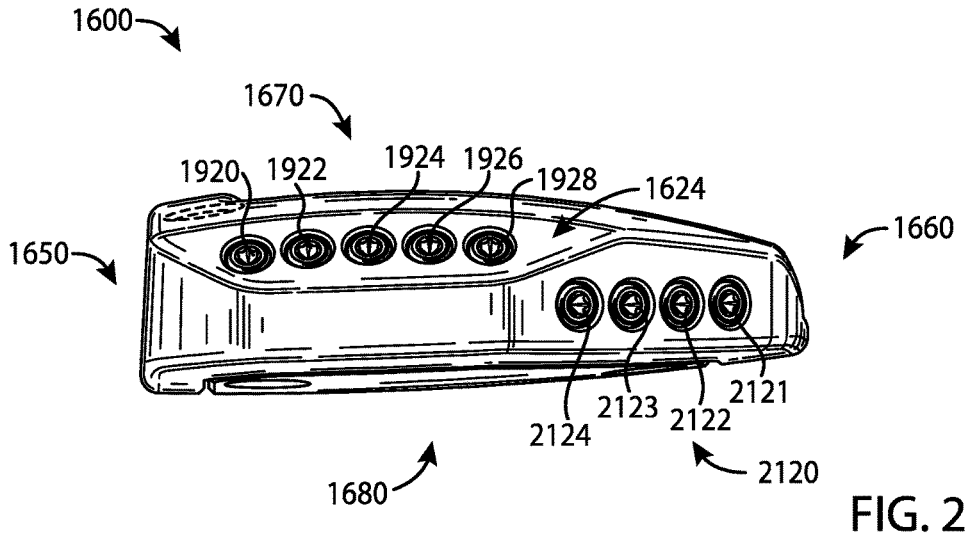
FIG. 21 depicts a left view of the example golf club head of FIG. 16.
Figure 22:
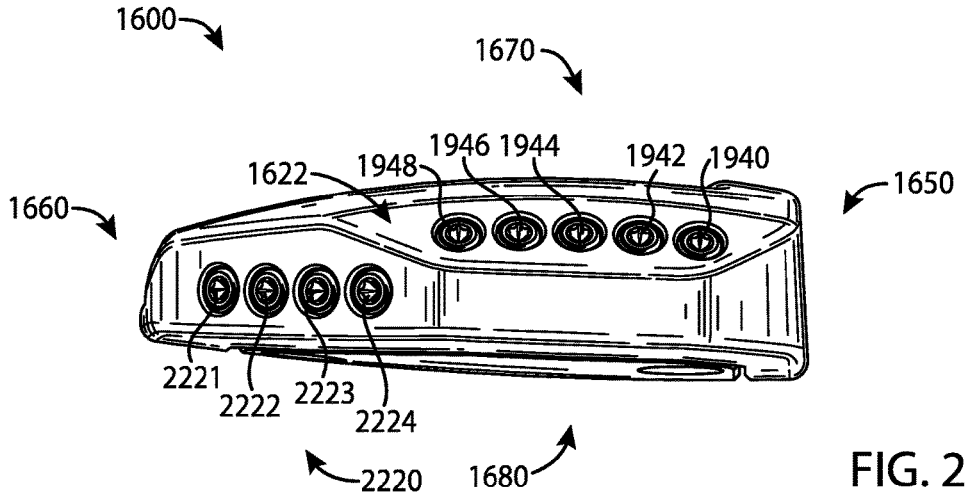
FIG. 22 depicts a right view of the example golf club head of FIG. 16.

FIG. 15 depicts one manner in which the example golf club head described herein may be manufactured. In the example of FIG. 15, the process 1500 may begin with providing a body portion 110 having a toe portion 130, a heel portion 140, a front portion 150, and a rear portion 160 (block 1510). The front portion 150 may include a strike face 155 to strike a golf ball. The body portion 110 may be manufactured via various manufacturing methods and/or processes (e.g., a casting process, a forging process, a milling process, etc.).

To provide a visual guide to strike the golf ball with the strike face, the process 1500 may provide a visual guide portion 120 extending between the front and rear portions 150 and 160 (block 1520). The visual guide portion 120 may include a first guide portion 122 located at or proximate to the toe portion 130, and a second guide portion 124 located at or proximate to the heel portion 140. The first and second guide portions 122 and 124, respectively, may be substantially parallel to each other. The visual guide portion 120 may be manufactured via various manufacturing methods and/or processes (e.g., a casting process, a forging process, a milling process, etc.). For example, the visual guide portion 120 may be manufactured with the same manufacturing process as the body portion 110 (e.g., a casting process or a milling process). In another example, the visual guide portion 120 may be manufactured with a milling process whereas the body portion 110 may be manufactured with a casting process. The apparatus, methods, and articles of manufacture described herein are not limited in this regard.

Referring back to FIG. 15, the example process 1500 is merely provided and described in conjunction with other figures as an example of one way to manufacture the golf club head 100. While a particular order of actions is illustrated in FIG. 15, these actions may be performed in other temporal sequences. For example, two or more actions depicted in FIG. 15 may be performed sequentially, concurrently, or simultaneously. In one example, blocks 1510 and 1520 may be performed simultaneously or concurrently. Although FIG. 15 depicts a particular number of blocks, the process may not perform one or more blocks. The apparatus, methods, and articles of manufacture described herein are not limited in this regard.

Turning to FIGS. 16-28, for example, a golf club head 1600 may include a body portion 1610 (e.g., FIGS. 23 and 24), and a visual guide portion 1620, generally shown as 1622, 1624, and 1626. The body portion 1610 may include a toe portion 1630, a heel portion 1640, a front portion 1650, a rear portion 1660, a top portion 1670, and a sole portion 1680. The body portion 1610 may also include a bore 1645 to receive a shaft (not shown). Alternatively, the body portion 1610 may include a hosel (not shown) to receive a shaft. The body portion 1610 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 1610 may be partially or entirely made of a non-metal material (e.g., composite, plastic, etc.). The apparatus, methods, and articles of manufacture described herein are not limited in this regard.

Figure 23:
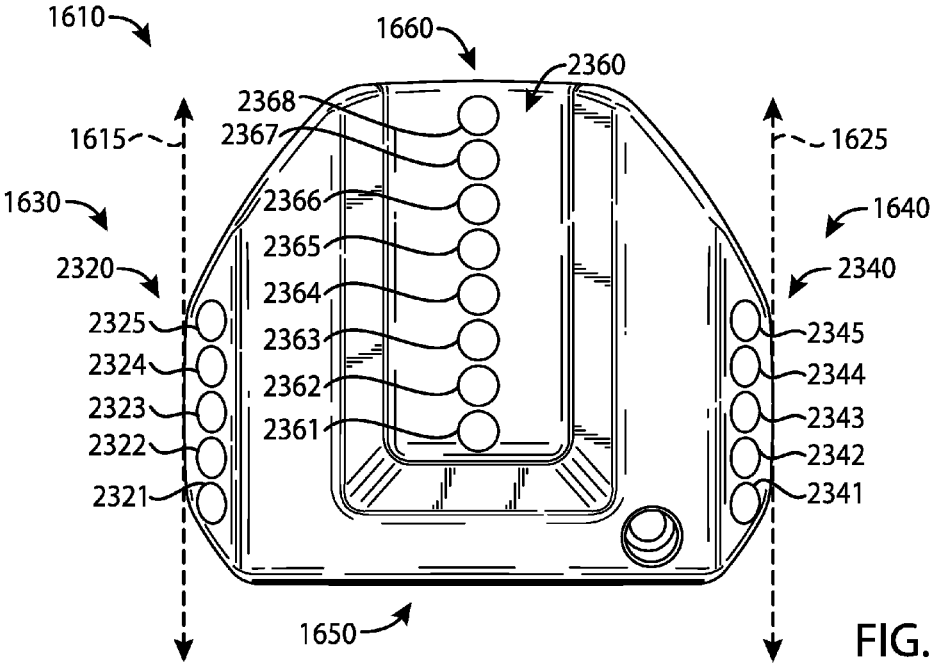
FIG. 23 depicts a top view of a body portion of the example golf club head of FIG. 16.

As illustrated in FIG. 23, for example, the body portion 1610 may include two or more weight ports, generally shown as a first set of weight ports 2320 (e.g., shown as weight ports 2321, 2322, 2323, 2324, and 2325) to form the first visual guide portion 1622 and a second set of weight ports 2340 (e.g., shown as weight ports 2341, 2342, 2343, 2344, and 2345) to form the second visual guide portion 1624. The first and second sets of weight ports 2320 and 2340, respectively, may be exterior weight ports configured to receive one or more weight portions (e.g., one shown as 2500 in FIG. 25). In particular, the first and second sets of weight ports 2320 and 2340 may be located at or proximate to a periphery of the golf club head 1600. For example, the first and second sets of weight ports 2320 and 2340, respectively, may be on or proximate to the top portion 1670. The first set of weight ports 2320 may be at or proximate to the toe portion 1630 whereas the second set of weight ports 2340 may be at or proximate to the heel portion 1640.

Each weight port of the first set of weight ports 2320 may have a first port diameter ($PD_1$). In particular, a uniform distance of less than the first port diameter may separate any two adjacent weight ports of the first set 2320 (e.g., (i) weight ports 2321 and 2322, (ii) weight ports 2322 and 2323, (iii) weight ports 2323 and 2324, or (iv) weight ports 2324 and 2325). In one example, the first port diameter may be about 0.25 inch and any two adjacent weight ports of the first set 2320 may be separated by 0.1 inch. In a similar manner, each weight port of the second set of weight ports 2340 may have a second diameter ($PD_2$). A uniform distance of less than the second port diameter may separate any two adjacent weight ports of the second set 2340 (e.g., (i) weight ports 2341 and 2342, (ii) weight ports 2342 and 2343, (iii) weight ports 2343 and 2344, or (iv) weight ports 2344 and 2345). The first and second port diameters may be equal to each other (i.e., $PD_1=PD_2$). For example, the second port diameter may be about 0.25 inch and any two adjacent weight ports of the second set 2340 may be separated by 0.1 inch. The apparatus, methods, and articles of manufacture described herein are not limited in this regard.

As noted above, the visual guide portion 1620 may include a third guide portion 1626. Accordingly, the body portion 1610 may include two or more weight ports, generally shown as a third set of weight ports 2360 (e.g., shown as weight ports 2361, 2362, 2363, 2364, 2365, 2366, 2367, and 2368) to form the third guide portion 1626. In particular, the third guide portion 1626 may be substantially equidistant from the first and second guide portions 1622 and 1624. For example, the third guide portion 1626 may extend between the front and rear portions 1650 and 1660 located at or proximate to a center of the body portion 1610. Each weight port of the third set of weight ports 2360 may have a third port diameter ($PD_3$). The third port diameter may be equal to the first port diameter or the second port diameter (e.g., $PD_1=PD_2=PD_3$). In particular, a uniform distance of less than the third port diameter may separate any two adjacent weight ports of the third set 2360 (e.g., (i) weight ports 2361 and 2362, (ii) weight ports 2362 and 2363, (iii) weight ports 2363 and 2364, (iv) weight ports 2364 and 2365, (v) weight ports 2365 and 2366, (vi) weight ports 2366 and 2367, or (vii) weight ports 2367 and 2368). The body portion 1610 may also include a U-shape recess portion 1690. The third guide portion 1626 may be located in the U-shape recess portion 1690. The apparatus, methods, and articles of manufacture described herein are not limited in this regard.

Figure 24:
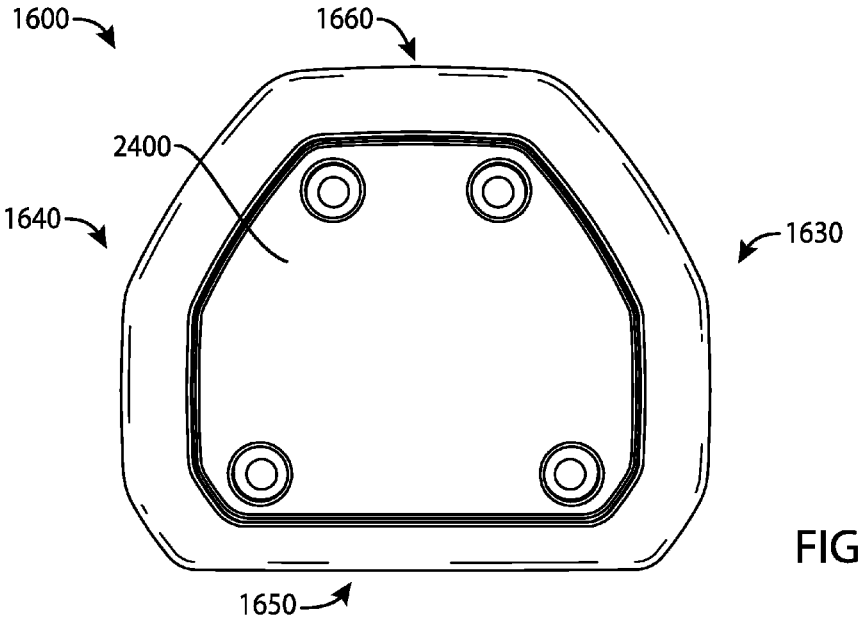
FIG. 24 depicts a bottom view of the example body portion of FIG. 23.

Further as shown in FIG. 24, the body portion 1610 may include an interior cavity 2400. The interior cavity 2400 may be partially or entirely filled with an elastic polymer or elastomer material, a thermoplastic elastomer material (TPE), a thermoplastic polyurethane material (TPU), and/or other suitable types of materials to absorb shock, isolate vibration, and/or dampen noise. A plate portion 2000 (FIG. 20) may cover the interior cavity 2400 from the sole portion 1680. The plate portion 2000 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 1610 may be partially or entirely made of a non-metal material (e.g., composite, plastic, etc.) with one shown as 2810 in FIG. 28.

In a similar manner to the visual guide portions 1222 and 1224 (FIGS. 12-14), the visual guide portions 1622 and 1624, respectively, may be located a particular distance from a first vertical plane 1615 and a second vertical plane 1625, respectively. For example, the visual guide portion 1622 may be located less than one inch from the first vertical plane 1615 and the visual guide portion 1624 may be located less than one inch from the second vertical plane 1625. Further, a distance 1910 may separate the visual guide portions 1622 and 1624, which may be greater than a diameter of a golf ball. In one example, the distance 1910 may be greater than three inches (3 in.). In another example, the distance 1910 may be about 3.75 inches.

The visual guide portions 1622 and 1624 may be located relative to the periphery of the golf club head 1600. In one example, the visual guide portion 1622 may be located less than 0.5 inch (12.7 mm) from the periphery at or proximate to the toe portion 1630 whereas the visual guide portion 1624 may be located less than 0.5 inch (12.7 mm) from the periphery at or proximate to the heel portion 1640. Further, each of the visual guide portions 1622 and 1624 may extend about a maximum length 1690 between the front and rear portions 1650 and 1660. Alternatively, each of the visual guide portions 1622 and 1624 may extend less than 50% of the maximum length 1690 between the front and rear portions 1650 and 1660. The apparatus, methods, and articles of manufacture described herein are not limited in this regard.

Instead of a solid line (e.g., the visual guide portions 1222 and 1224), each of the visual guide portions 1622 and 1624, respectively, may be dotted lines formed by two or more weight portions, generally shown as a first set of weight portions 1920 (e.g., shown as 1921, 1922, 1923, 1924, and 1925) and a second set of weight portions 1940 (e.g., shown as 1941, 1942, 1943, 1944, and 1945). In a similar manner, the visual guide portion 1626 may be a dotted line formed by two or more weight portions, generally shown as the third set of weight portions 1960 (e.g., shown as 1961, 1962, 1963, 1964, 1965, 1966, 1967, and 1968). The first, second, and third sets of weight portions 1920, 1940, and 1960, respectively, may be partially or entirely made of a high-density material such as a tungsten-based material or suitable types of materials. Alternatively, the first, second, and third sets of weight portions 1920, 1940, and 1960, respectively, may be partially or entirely made of a non-metal material (e.g., composite, plastic, etc.). The apparatus, methods, and articles of manufacture described herein are not limited in this regard.

Figure 25:
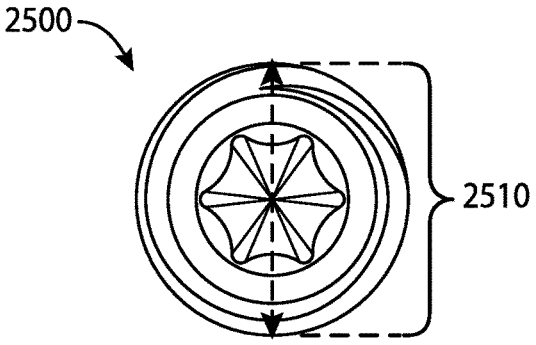
FIG. 25 depicts a top view of a weight portion associated with the example golf club head of FIG. 16.
Figure 26:
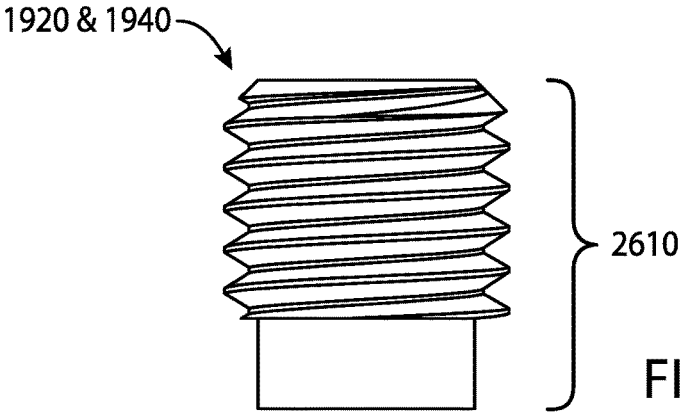
FIG. 26 depicts a side view of a weight portion associated with the example golf club head of FIG. 16.
Figure 27:
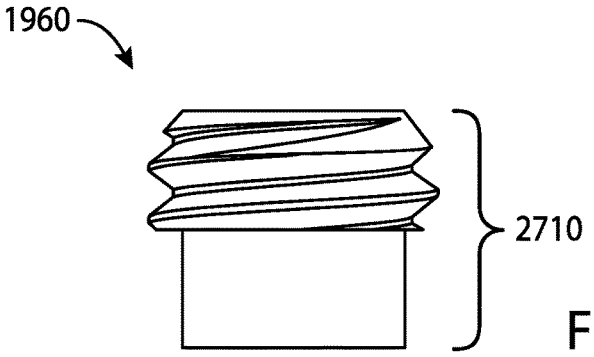
FIG. 27 depicts a side view of another weight portion associated with the example golf club head of FIG. 16.
Figure 28:
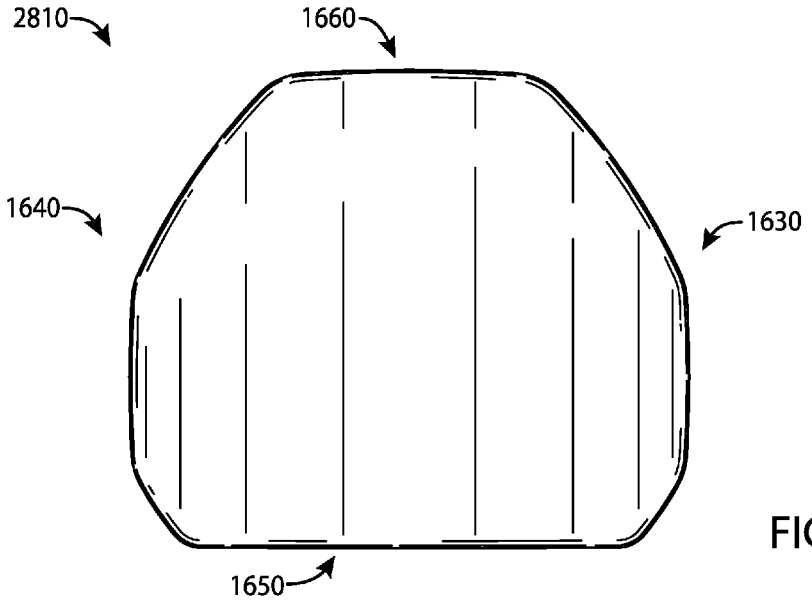
FIG. 28 depicts a bottom view of another example body portion of FIG. 16.

The first, second, and third sets of weight portions 1920, 1940, and 1960, respectively, may have similar or different physical properties (e.g., density, shape, mass, volume, size, color, etc.). In the illustrated example as shown in FIGS. 25-27, each of the weight portions of the first, second, and third sets 1920, 1940, and 1960 may have a cylindrical shape (e.g., a circular cross section). Alternatively, each of the weight portions of the first and second sets 1920 and 1940 may have a first shape (e.g., a cylindrical shape) whereas each of the weight portions of the third set 1960 may have a second shape (e.g., a rectangular shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

Further, each of the weight portions of the first, second, and third sets 1920, 1940, and 1960, respectively, may have a diameter 2510 of about 0.25 inch but the first, second, and third sets of weight portions 1920, 1940, and 1960, respectively, may be different in height. In particular, each of the weight portions of the first and second sets 1920 and 1940 may be associated with a first height 2610 (FIG. 26), and each of the weight portion of the third set 1960 may be associated with a second height 2710 (FIG. 27). The first height 2610 may be relatively longer than the second height 2710. In one example, the first height 2610 may be about 0.3 inch whereas the second height 2710 may be about 0.16 inch.

Alternatively, the first height 2610 may be equal to or less than the second height 2710. The apparatus, methods, and articles of manufacture described herein are not limited in this regard.

The first and second sets of weight portions 1920 and 1940, respectively, may include threads to secure in the weight ports. For example, each weight portion of the first and second sets of weight portions 1920 and 1940 may be a screw. The first and second sets of weight portions 1920 and 1940, respectively, may not be readily removable from the body portion 1610 with or without a tool. Alternatively, the first and second sets of weight portions 1920 and 1940, respectively, may be readily removable (e.g., with a tool) so that a relatively heavier or lighter weight portion may replace one or more of the weight portions of the first and second sets 1920 and 1940, respectively. In another example, the first and second sets of weight portions 1920 and 1940, respectively, may be secured in the weight ports of the body portion 1610 with epoxy or adhesive so that the first and second sets of weight portions 1920 and 1940, respectively, may not be readily removable. In yet another example, the first and second sets of weight portions 1920 and 1940, respectively, may be secured in the weight ports of the body portion 1610 with both epoxy and threads so that the first and second sets of weight portions 1920 and 1940, respectively, may not be readily removable. The apparatus, methods, and articles of manufacture described herein are not limited in this regard.

The golf club head 1600 may also include a fourth set of weight portions 2120 (e.g., shown as 2121, 2122, 2123, and 2124) and a fifth set of weight portions 2220 (e.g., shown as 2221, 2222, 2223, and 2224). Although both the fourth and fifth sets of weight portions 2120 and 2220 may be located at or proximate to the rear portion 1660, the fourth set of weight portions 2120 may be located at or proximate to the heel portion 1640 whereas the fifth set of weight portions 2220 may be at or proximate to the toe portion 1630. Each of the fourth and fifth sets of weight portions 2120 and 2220 may include at least three weight portions. The apparatus, methods, and articles of manufacture described herein are not limited in this regard.

Figure 29:
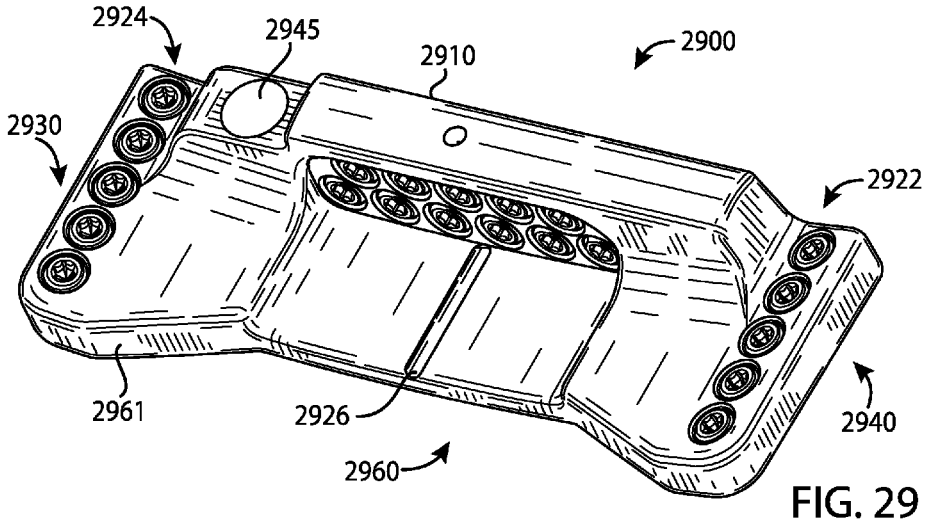
FIG. 29 depicts a rear perspective view of a golf club head according to yet another embodiment of the apparatus, methods, and articles of manufacture described herein.
Figure 30:
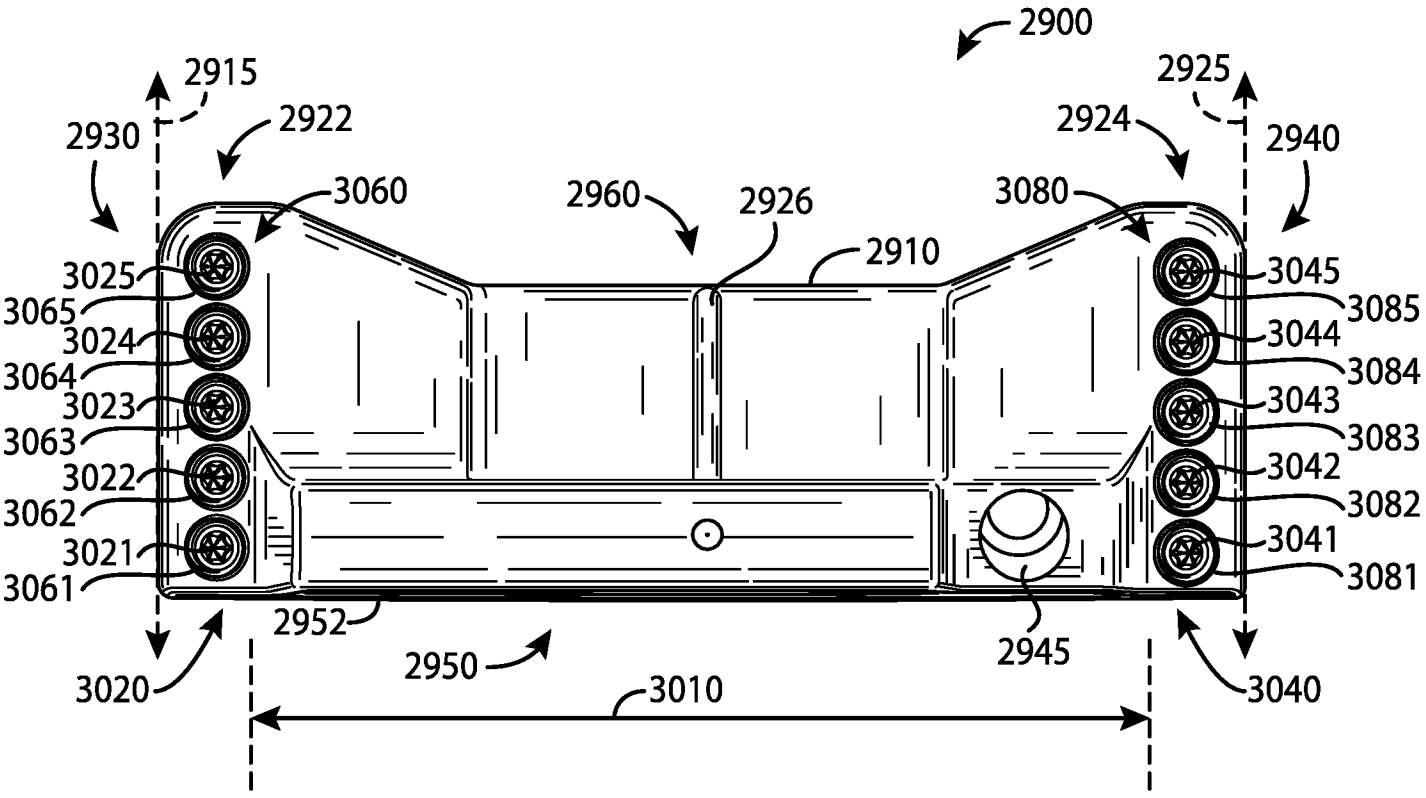
FIG. 30 depicts a top view of the example golf club head of FIG. 29.
Figure 31:
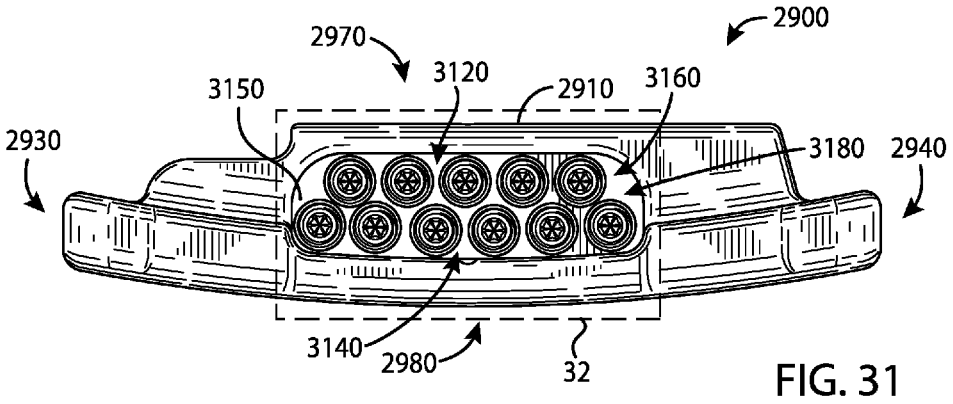
FIG. 31 depicts a rear view of the example golf club head of FIG. 29.
Figure 32:
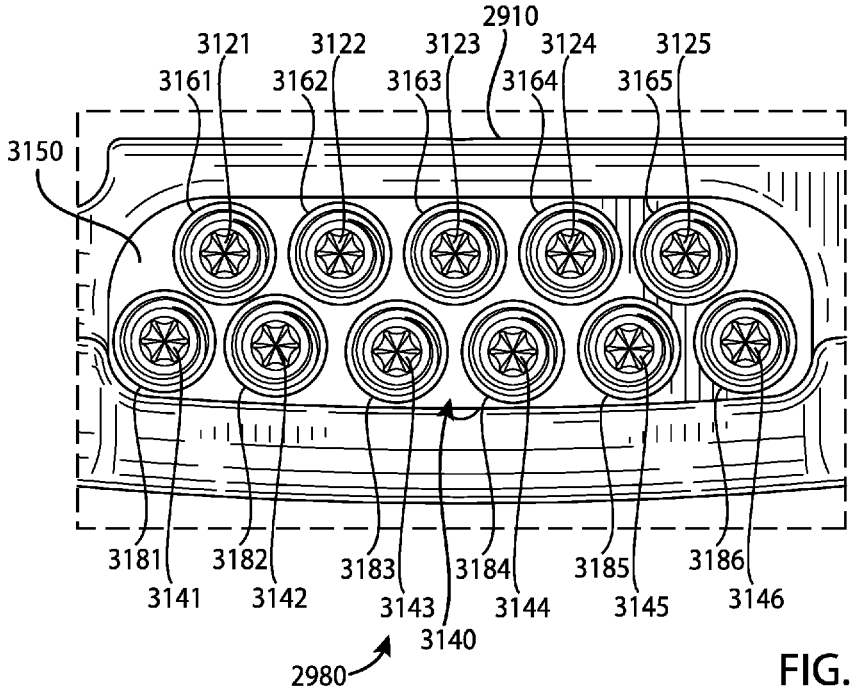
FIG. 32 depicts an enlarged view of the rear view of FIG. 31.
Figure 33:
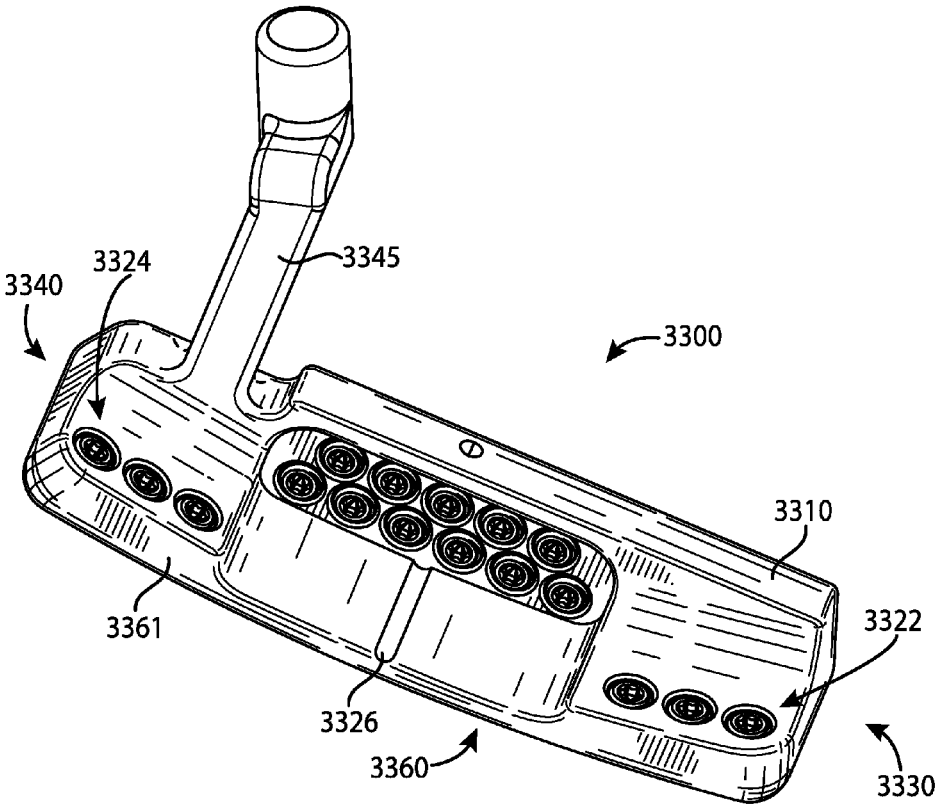
FIG. 33 depicts a rear perspective view of a golf club head according to yet another embodiment of the apparatus, methods, and articles of manufacture described herein.
Figure 34:
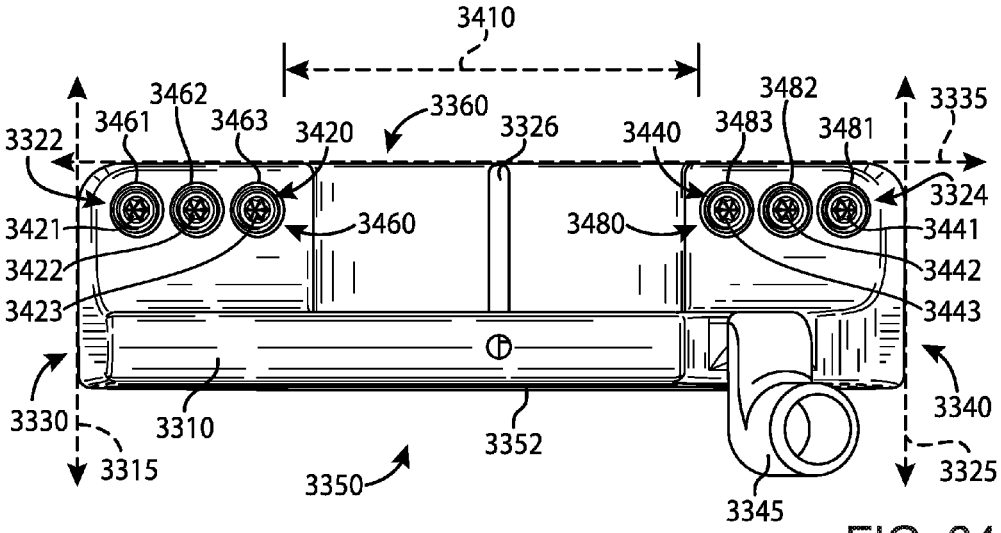
FIG. 34 depicts a top view of the example golf club head of FIG. 33.
Figure 35:
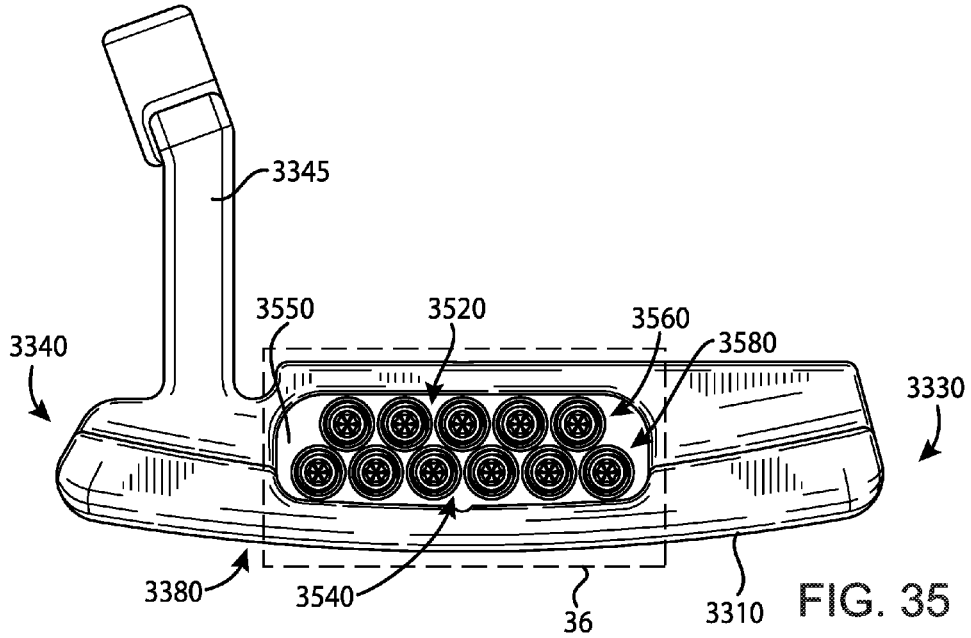
FIG. 35 depicts a rear view of the example golf club head of FIG. 33.
Figure 36:
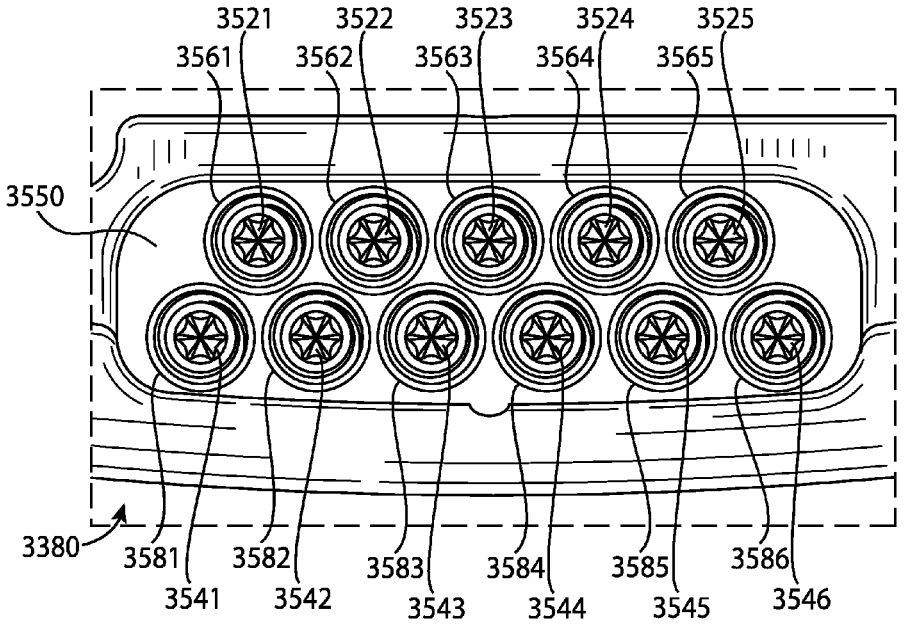
FIG. 36 depicts an enlarged view of the rear view of FIG. 35.

Although the above examples may describe a particular number of visual guide portions, weight ports, and weight portions, the apparatus, methods, and articles of manufacture described herein may include more or less visual guide portions, weight ports, and/or weight portions. While FIGS. 16-24 may depict a particular type of putter club head (e.g., a mallet-type putter club head), the apparatus, methods, and articles of manufacture described herein may be applicable to other types of putters. As illustrated in FIG. 29, the apparatus, methods, and articles of manufacture described herein may be applicable to a blade-type putter club head 2900. For example, the golf club head 2900 may include a body portion 2910, and a visual guide portions, generally shown as 2922, 2924, and 2926. The body portion 2910 may include a toe portion 2930, a heel portion 2940, a front portion 2950, a rear portion 2960, a top portion 2970, and a bottom portion 2980. The body portion 2910 may also include a bore 2945 to receive a shaft (not shown). Alternatively, the body portion 2910 may include a hosel (not shown) to receive a shaft. The body portion 2910 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 2910 may be partially or entirely made of a non-metal material (e.g., composite, plastic, etc.). The apparatus, methods, and articles of manufacture described herein are not limited in this regard.

In a similar manner to the visual guide portions 1622 and 1624 (FIGS. 16-24), the visual guide portions 2922 and 2924, respectively, may be located a particular distance from a first vertical plane 2915 and a second vertical plane 2925, respectively. For example, the visual guide portion 2922 may be located less than one inch from the first vertical plane 2915 and the visual guide portion 2924 may be located less than one inch from the second vertical plane 2925. Further, a distance 3010 may separate the visual guide portions 2922 and 2924, which may be greater than a diameter of a golf ball. In one example, the distance 3010 may be greater than three inches (3 in.). In another example, the distance 3010 may be about 3.75 inches.

The visual guide portions 2922 and 2924 may be located relative to the periphery of the golf club head 2900. In one example, the visual guide portion 2922 may be located less than 0.5 inch (12.7 mm) from the periphery at or proximate to the toe portion 2930 whereas the visual guide portion 2924 may be located less than 0.5 inch (12.7 mm) from the periphery at or proximate to the heel portion 2940. Further, each of the visual guide portions 2922 and 2924 may extend about a maximum length between the front and rear portions 2950 and 2960, respectively. Alternatively, each of the visual guide portions 2922 and 2924 may extend less than 50% of the maximum length between the front and rear portions 2950 and 2960, respectively. The apparatus, methods, and articles of manufacture described herein are not limited in this regard.

Each of the visual guide portions 2922 and 2924 may be dotted lines formed by weight portions, generally shown as a first set of weight portions 3020 (e.g., shown as 3021, 3022, 3023, 3024, and 3025) and a second set of weight portions 3040 (e.g., shown as 3041, 3042, 3043, 3044, and 3045) configured to engage a first set of weight ports 3060 (e.g., shown as 3061, 3062, 3063, 3064 and 3065) and the second set of weight ports 3080 (e.g., show as 3081, 3082, 3083, 3084 and 3085), respectively. Alternatively, each of the visual guide portions 2922 and 2924 may be dotted lines formed by the first set of weight ports 3060 and the second set of weight ports 3080 with some or all of the weight ports not having any weight portions secured therein. The first and second sets of weight portions 3020 and 3040, respectively, may be partially or entirely made of a high-density material such as a tungsten-based material or suitable types of materials. Alternatively, the first and second sets of weight portions 3020 and 3040, respectively, may be partially or entirely made of a non-metal material (e.g., composite, plastic, etc.). The apparatus, methods, and articles of manufacture described herein are not limited in this regard.

The weight portions of each of the first and second sets of weight portions 3020 and 3040, respectively, may have similar or different physical properties (e.g., density, shape, mass, volume, size, color, etc.). For example, the weight portions of the first set of weight portions 3020 may have the same properties whereas the weight portions of the second set of weight portions 3040 may have the same properties but different properties than the weight portions of the first set of weight portions 3020. In another example, the weight portions of the first set of weight portions 3020 may have different properties and/or the weight portions of the second set of weight portions 3040 may have different properties. In the illustrated example as shown in FIGS. 25-27, each of the weight portions of the first and second sets 3020 and 3040, respectively, may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

The first and second sets of weight portions 3020 and 3040, respectively, may include threads to secure in the weight ports of the first set of weight ports 3060 and the second set of weight ports 3080, which may also have corresponding threads. For example, each weight portion of the first and second sets of weight portions 3020 and 3040 may be a screw. The first and second sets of weight portions 3020 and 3040, respectively, may not be readily removable from the body portion 2910 with or without a tool. Alternatively, the first and second sets of weight portions 3020 and 3040, respectively, may be readily removable (e.g., with a tool) so that a relatively heavier or lighter weight portion may replace one or more of the weight portions of the first and second sets 3020 and 3040, respectively. In another example, the first and second sets of weight portions 3020 and 3040, respectively, may be secured in the weight ports of the first set of weight ports 3060 and the second set of weight ports 3080 with epoxy or adhesive so that the first and second sets of weight portions 3020 and 3040, respectively, may not be readily removable. In yet another example, the first and second sets of weight portions 3020 and 3040, respectively, may be secured in the weight ports of the first set of weight ports 3060 and the second set of weight ports 3080 with both epoxy and threads so that the first and second sets of weight portions 3020 and 3040, respectively, may not be readily removable. The apparatus, methods, and articles of manufacture described herein are not limited in this regard.

The visual guide portion 2926 may be defined by a generally linear recess or projection extending between the front portion 2950 and the rear portion 2960. The visual guide portion 2926 may be substantially equidistant from the first and second guide portions 2922 and 2924, respectively. For example, the guide portion 2926 may extend between the front and rear portions 2950 and 2960, respectively, located at or proximate to a center of the body portion 2910. Alternatively, the visual guide portion 2926 may be defined by a plurality of weight ports with each weight port receiving a weight portion similar to the third visual guide portion 1626 of the golf club head 1610. The apparatus, methods, and articles of manufacture described herein are not limited in this regard.

The front portion 2950 may include a face portion 2952 (e.g., a strike face). The rear portion 2960 may include a plurality of weight portions, generally shown as a third set of weight portions 3120 (e.g., shown as 3121, 3122, 3123, 3124 and 3125) and a fourth set of weight portions 3140 (e.g., shown as 3141, 3142, 3143, 3144, 3145 and 3146). The third set of weight portions 3120 and the fourth set of weight portions 3140 may be secured in a plurality of weight ports, generally shown as a third set of weight ports 3160 (e.g., shown as 3161, 3162, 3163, 3164 and 3165) and a fourth set of weight ports 3180 (e.g., shown as 3181, 3182, 3183, 3184, 3185 and 3186). The third set of weight ports 3160 and the fourth set of weight ports 3180 are formed in a back wall portion 3150, which is located opposite the face portion 2952 between the face portion 2952 and a back end 2961 (shown in FIG. 29) of the rear portion 2960. The third set of weight ports 3160 may be located between the fourth set of weight ports 3180 and the top portion 2970. The fourth set of weight ports 3180 may be located between the third set of weight ports 3160 and the bottom portion 2980. The locations of third set of weight ports 3160 and the fourth set of weight ports 3180 and inclusion of some or all of the third set of weight portions 3120 and the fourth set of weight portions 3140 in the weight ports 3160 and 3180 may affect the sound and feel of the golf club head to an individual using the golf club to strike a ball. Furthermore, the locations of third set of weight ports 3160 and the fourth set of weight ports 3180 and inclusion of some or all of the third set of weight portions 3120 and the fourth set of weight portions 3140 in the weight ports 3160 and 3180 may affect the total weight and the location of the center of gravity of the golf club head. Accordingly, the sound, feel, weight and center of gravity location of the golf club head may be adjustable to provide a particular sound, feel, weight and/or swing characteristics for an individual. The third set of weight ports

3160 and the fourth set of weight ports 3180 may be configured on the back wall portion 3150 between the top portion 2970 and the bottom portion 2980. The weight ports of the third set of weight ports 3160 extend between the toe portion 2930 and the heel portion 2940, and the weight ports of the fourth set of weight ports 3180 extend between the toe portion 2930 and the heel portion 2940. The weight ports of the third set of weight ports 3160 may be aligned substantially linearly and extend between the toe portion 2930 and the heel portion 2940. Alternatively, the weight ports of the third set of weight ports 3160 may be aligned and extend between the toe portion 2930 and the heel portion 2940 according to a contour of the top portion 2970 or the bottom portion 2980. Alternatively yet, the weight ports of the third set of weight ports 3160 may extend between the toe portion 2930 and the heel portion 2940 in any configuration. The weight ports of the fourth set of weight ports 3180 may be aligned substantially linearly and extend between the toe portion 2930 and the heel portion 2940. Alternatively, the weight ports of the fourth set of weight ports 3180 may be aligned and extend between the toe portion 2930 and the heel portion 2940 according to a contour of the top portion 2970 or the bottom portion 2980. Alternatively yet, the weight ports of the fourth set of weight ports 3180 may extend between the toe portion 2930 and the heel portion 2940 in any configuration. In one example, the first set of weight ports 3160 and the second set of weight ports 3180 may appear as substantially parallel rows of weight ports extending between the toe portion 2930 and the heel portion 2940.

Each of the weight ports of the third set of weight ports 3160 may be above and staggered relative to adjacent weight ports of the fourth set of weight ports 3180. Each of the weight ports of the fourth set of weight ports 3180 may be below and staggered relative to adjacent weight ports of the third set of weight ports 3160. In one example, the weight ports of the third set of weight ports 3160 and the weight ports of the fourth set of weight ports 3180 may be generally aligned in a vertical direction (i.e., not staggered, not shown). The third and fourth sets of weight portions 3120 and 3140, respectively, may be partially or entirely made of a high-density material such as a tungsten-based material or suitable types of materials. Alternatively, the third and fourth sets of weight portions 3120 and 3140, respectively, may be partially or entirely made of a non-metal material (e.g., composite, plastic, etc.). The apparatus, methods, and articles of manufacture described herein are not limited in this regard.

The weight portions of each of the first, second, third and fourth sets of weight portions 3020, 3040, 3120 and 3140, respectively, may have similar or different physical properties (e.g., density, shape, mass, volume, size, color, etc.). For example, the weight portions of the third set of weight portions 3120 may have the same properties, while the weight portions of the fourth set of weight portions 3140 may have the same properties but different properties than the weight portions of the third set of weight portions 3120. In another example, the weight portions of the third set of weight portions 3120 may have different properties and/or the weight portions of the fourth set of weight portions 3140 may have different properties. In the illustrated example as shown in FIGS. 25-27, each of the weight portions of the third and fourth sets 3120 and 3140 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

The third and fourth sets of weight portions 3120 and 3140, respectively, may include threads to secure in the weight ports of the third set of weight ports 3160 and the fourth set of weight ports 3180, which may also have corresponding threads. The third and fourth sets of weight portions 3120 and 3140, respectively, may include threads to secure in the weight ports of the first set of weight ports 3060 and the second set of weight ports 3080, which may also have corresponding threads. For example, each weight portion of the third and fourth sets of weight portions 3120 and 3140, respectively, may be a screw. The third and fourth sets of weight portions 3120 and 3140, respectively, may not be readily removable from the body portion 2910 with or without a tool. Alternatively, the third and fourth sets of weight portions 3120 and 3140, respectively, may be readily removable (e.g., with a tool) so that a relatively heavier or lighter weight portion may replace one or more of the weight portions of the third and fourth sets 3120 and 3140, respectively. In another example, the third and fourth sets of weight portions 3120 and 3140, respectively, may be secured in the weight ports of the third set of weight ports 3160 and the fourth set of weight ports 3180 with epoxy or adhesive so that the third and fourth sets of weight portions 3120 and 3140, respectively, may not be readily removable. In yet another example, the third and fourth sets of weight portions 3120 and 3140, respectively, may be secured in the weight ports of the third set of weight ports 3160 and the fourth set of weight ports 3180 with both epoxy and threads so that the third and fourth sets of weight portions 3120 and 3140, respectively, may not be readily removable.

Each weight port of the first set of weight ports 3060 may have a first port diameter ($PD_1$). In particular, a uniform distance of less than the first port diameter may separate any two adjacent weight ports of the first set 3060 (e.g., (i) weight ports 3061 and 3062, (ii) weight ports 3062 and 3063, (iii) weight ports 3063 and 3064, or (iv) weight ports 3064 and 3065). In one example, the first port diameter may be about 0.25 inch and any two adjacent weight ports of the first set 3060 may be separated by 0.1 inch.

In a similar manner, each weight port of the second set of weight ports 3080 may have a second port diameter ($PD_2$). A uniform distance of less than the second port diameter may separate any two adjacent weight ports of the second set 3080 (e.g., (i) weight ports 3081 and 3082, (ii) weight ports 3082 and 3083, (iii) weight ports 3083 and 3084, or (iv) weight ports 3084 and 3085). For example, the second port diameter may be about 0.25 inch and any two adjacent weight ports of the second set 3080 may be separated by 0.1 inch.

In a similar manner, each weight port of the third set of weight ports 3160 may have a third port diameter ($PD_3$). A uniform distance of less than the third port diameter may separate any two adjacent weight ports of the third set 3160 (e.g., (i) weight ports 3161 and 3162, (ii) weight ports 3162 and 3163, (iii) weight ports 3163 and 3164, or (iv) weight ports 3164 and 3165). For example, the third port diameter may be about 0.25 inch and any two adjacent weight ports of the third set 3160 may be separated by 0.1 inch.

In a similar manner, each weight port of the fourth set of weight ports 3180 may have a fourth port diameter ($PD_4$). A uniform distance of less than the fourth port diameter may separate any two adjacent weight ports of the fourth set 3180 (e.g., (i) weight ports 3181 and 3182, (ii) weight ports 3182 and 3183, (iii) weight ports 3183 and 3184, (iv) weight ports 3184 and 3185, or (v) weight ports 3185 and 3186). For example, the fourth port diameter may be about 0.25 inch and any two adjacent weight ports of the fourth set 3180 may be separated by 0.1 inch.

Any two or more of the first, second, third, and fourth port diameters may be generally equal to each other (e.g., $PD_1=PD_2=PD_3=PD_4$) or not equal to each other (e.g., $PD_1=PD_2=PD_3\neq PD_4$). The apparatus, methods, and articles of manufacture described herein are not limited in this regard.

A uniform distance of less than the third port diameter or the fourth port diameter may separate any two adjacent weight ports of the third set 3160 and the fourth set 3180 (e.g., (i) weight ports 3181 and 3161, (ii) weight ports 3161 and 3182, (iii) weight ports 3182 and 3162, (iv) weight ports 3162 and 3183, (v) weight ports 3183 and 3163, (vi) weight ports 3163 and 3184, (vii) weight ports 3184 and 3164, (viii) weight ports 3164 and 3185, (ix) weight ports 3185 and 3165, or (x) weight ports 3165 and 3186). The weight portions of the first set of weight portions 3020, the second set of weight portions 3040, the third set of weight portions 3120, and the fourth set of weight portions 3140 may be used in any of the weight ports of the first set of weight ports 3002, the second set of weight ports 3004, the third set of weight ports 3160 and the fourth set of weight ports 3180. The apparatus, methods, and articles of manufacture described herein are not limited in this regard.

The weight portions of the first set 3020, the second set 3040, third set 3120, and the fourth set 3140 may be interchangeable with other weight portions having different mass configurations so that the center of gravity, moment of inertia and/or other weight and inertia characteristics of the golf club may be adjusted. For example, the overall mass of the first set of weight portions 3020 may be greater than the overall mass of the second set of weight portions 3040 to provide a toe-weighted bias for the golf club head 2900. In another example, the overall mass of fourth set of weight portions 3140 may be greater than or less than the overall mass of the third set of weight portions 3120 to position the center of gravity of the golf club head 2900 lower or higher, respectively. The fourth set of weight ports 3180 may have a greater number of weight ports than the third set of weight ports 3160. Accordingly, when the weight portions of the third set of weight portions 3120 and the weight portions of the fourth set of weight portions 3140 have the same mass, the overall mass of the fourth set of weight portions 3140 is greater than the overall mass of the third set of weight portions 3120. In one example, some or all of the weight portions of the third set of weight portions 3120 may have a greater mass than some of all of the weight portions of the fourth set of weight portions 3140 so that the overall mass of the third set of weight portions 3120 is greater than the overall mass of the fourth set of weight portions 3140. The third set of weight portions 3120 and the fourth set of weight portions 3140 may have the same mass. In another example, the weight portions of the third and fourth set of weight portions 3120 and 3140, respectively, that are near the toe portion 2930 may have a greater overall mass that the weight portions of the third and fourth set of weight portions 3120 and 3140, respectively, that are near the heel portion 2940 so that the overall mass of the third and fourth set of weight portions 3120 and 3140, respectively, near the toe portion 2930 is greater than the overall mass near the heel portion 2940. In another example, the weight portions of the third and fourth set of weight portions 3120 and 3140, respectively, that are near the heel portion 2940 may have a greater overall mass that the weight portions of the third and fourth set of weight portions 3120 and 3140, respectively, that are near the toe portion 2930 so that the overall mass of the third and fourth set of weight portions 3120 and 3140, respectively, near the heel portion 2940 is greater than the overall mass near the toe portion 2930. Thus, the weight portions of the third set of weight portions 3120 and the fourth set of weight portions 3140 can be configured so as to adjust and provide a particular location for the center of gravity of the golf club head 3140. Thus, the weight portions of the golf club head 2900 may be configured in any manner to provide a particular configuration of the golf club head 2900.

Turning to FIGS. 33-36, for example, a blade-type putter club head 3300 may include a body portion 3310, and a visual guide portions, generally shown as 3322, 3324, and 3326. The body portion 3310 may include a toe portion 3330, a heel portion 3340, a front portion 3350, a rear portion 3360, a top portion 3370 and a bottom portion 3380. The front portion 3350 may include a face portion 3352 (e.g., a strike face). The face portion 3352 may be used to impact a golf ball (one shown as 500 in FIG. 5). The body portion 3310 may also include a hosel portion 3345 to receive a shaft (not shown). The body portion 3310 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 3310 may be partially or entirely made of a non-metal material (e.g., composite, plastic, etc.). The apparatus, methods, and articles of manufacture described herein are not limited in this regard.

The visual guide portions 3322 and 3324 may be located a particular distance from a first vertical plane 3315 and a second vertical plane 3325, respectively. For example, one end of the visual guide portion 3322 may be located less than one inch from the first vertical plane 3315 and extend toward the heel portion 3340 to the opposite end of the visual guide portion 3322. For example, one end of the visual guide portion 3324 may be located less than one inch from the second vertical plane 3325 and extend toward the toe portion 3330 to the opposite end of the visual guide portion 3324. The visual guide portions 3322 and 3324 may also be located a particular distance from a third vertical plane 3335, which may be parallel to the face portion 3352 and/or may be perpendicular to the vertical planes 3315 and 3325 and a ground plane 200 (FIGS. 2 and 3). For example, the visual guide portions 3322 and 3324 may be each located less than one inch from the vertical plane 3335. Further, a distance 3410 may separate the visual guide portions 3322 and 3324. The distance 3410 may be greater than a diameter of a golf ball. In one example, the distance 3410 may be greater than three (3) inches. In another example, the distance 3410 may be about 3.75 inches. The parallel configuration of the visual guide portions 3322 and 3324 relative to the face portion 3352 may assist an individual to visually adjust an angle of the face portion 3352 in the address position.

The visual guide portions 3322 and 3324 may be located relative to the periphery of the golf club head 3300. In one example, one end of the visual guide portion 3322 may be located less than 0.5 inch (12.7 mm) from the periphery at or proximate to the toe portion 3330 and extend toward the heel portion 3340 to an opposite end of the visual guide portion 3322. In one example, the visual guide portion 3322 may be less than 0.5 inch (12.7 mm) from the periphery at or proximate to the rear portion 3360. In one example, one end of the visual guide portion 3324 may be located less than 0.5 inch (12.7 mm) from the periphery at or proximate to the heel portion 3340 and extend toward the toe portion 3330 to an opposite end of the visual guide portion 3324. In one example, the visual guide portion 3324 may be less than 0.5 inch (12.7 mm) from the periphery at or proximate to the rear portion 3360. Further, each of the visual guide portions 3322 and 3324 may extend a particular length between the toe and heel portions 3330 and 3340. For example, each of the visual guide portions 3322 and 3324 may extend less than 50% of the maximum length between the toe and heel portions 3330 and 3340. The apparatus, methods, and articles of manufacture described herein are not limited in this regard.

Each of the visual guide portions 3322 and 3324 may be dotted lines formed by weight portions, generally shown as a first set of weight portions 3420 (e.g., shown as 3421, 3422, and 3423) and a second set of weight portions 3440 (e.g., shown as 3441, 3442, and 3443) configured to engage a first set of weight ports 3460 (e.g., shown as 3461, 3462 and 3463) and the second set of weight ports 3480 (e.g., show as 3481, 3482, and 3483), respectively. Alternatively, each of the visual guide portions 3322 and 3324 may be dotted lines formed by the first set of weight ports 3460 and the second set of weight ports 3480 with some or all of the weight ports not having any weight portions secured therein. The first and second sets of weight portions 3420 and 3440, respectively, may be partially or entirely made of a high-density material such as a tungsten-based material or suitable types of materials. Alternatively, the first and second sets of weight portions 3420 and 3440, respectively, may be partially or entirely made of a non-metal material (e.g., composite, plastic, etc.). The apparatus, methods, and articles of manufacture described herein are not limited in this regard.

The weight portions of each of the first and second sets of weight portions 3420 and 3440, respectively, may have similar or different physical properties (e.g., density, shape, mass, volume, size, color, etc.). For example, the weight portions of the first set of weight portions 3420 may have the same properties whereas the weight portions of the second set of weight portions 3440 may have the same properties but different properties than the weight portions of the first set of weight portions 3420. In another example, the weight portions of the first set of weight portions 3420 may have different properties and/or the weight portions of the second set of weight portions 3440 may have different properties. In the illustrated example as shown in FIGS. 25-27, each of the weight portions of the first and second sets 3420 and 3440, respectively, may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

The first and second sets of weight portions 3420 and 3440, respectively, may include threads to secure in the weight ports of the first set of weight ports 3460 and the second set of weight ports 3480, which may also have corresponding threads. For example, each weight portion of the first and second sets of weight portions 3420 and 3440 may be a screw. The first and second sets of weight portions 3420 and 3440, respectively, may not be readily removable from the body portion 3310 with or without a tool. Alternatively, the first and second sets of weight portions 3420 and 3440, respectively, may be readily removable (e.g., with a tool) so that a relatively heavier or lighter weight portion may replace one or more of the weight portions of the first and second sets 3420 and 3440, respectively. In another example, the first and second sets of weight portions 3420 and 3440, respectively, may be secured in the weight ports of the first set of weight ports 3460 and the second set of weight ports 3480 with epoxy or adhesive so that the first and second sets of weight portions 3420 and 3440, respectively, may not be readily removable. In yet another example, the first and second sets of weight portions 3420 and 3440, respectively, may be secured in the weight ports of the first set of weight ports 3460 and the second set of weight ports 3480 with both epoxy and threads so that the first and second sets of weight portions 3420 and 3440, respectively, may not be readily removable. The apparatus, methods, and articles of manufacture described herein are not limited in this regard.

The visual guide portion 3326 may be defined by a generally linear recess or projection extending between the front portion 3350 and the rear portion 3360. The visual guide portion 3326 may be substantially equidistant from the first and second guide portions 3322 and 3324, respectively. For example, the guide portion 3326 may extend between the front and rear portions 3350 and 3360, respectively, located at or proximate to a center of the body portion 3310. Alternatively, the visual guide portion 3326 may be defined by a plurality of weight ports with each weight port receiving a weight portion similar to the third visual guide portion 1626 of the golf club head 1610. The apparatus, methods, and articles of manufacture described herein are not limited in this regard.

The front portion 3350 may include a face portion 3352 (e.g., a strike face). The rear portion 3360 may include a plurality of weight portions, generally shown as a third set of weight portions 3520 (e.g., shown as 3521, 3522, 3523, 3524 and 3525) and a fourth set of weight portions 3540 (e.g., shown as 3541, 3542, 3543, 3544, 3545 and 3546). The third set of weight portions 3520 and the fourth set of weight portions 3540 may be secured in a plurality of weight ports, generally shown as a third set of weight ports 3560 (e.g., shown as 3561, 3562, 3563, 3564 and 3565) and a fourth set of weight ports 3580 (e.g., shown as 3581, 3582, 3583, 3584, 3585 and 3586). The third set of weight ports 3560 and the fourth set of weight ports 3580 are formed in a back wall portion 3550, which is located opposite the face portion 3352 between the face portion 3352 and a back end 3361 (shown in FIG. 33) of the rear portion 3360. The third set of weight ports 3560 may be located between the fourth set of weight ports 3580 and the top portion 3370. The fourth set of weight ports 3580 may be located between the third set of weight ports 3560 and the bottom portion 3380. The locations of third set of weight ports 3560 and the fourth set of weight ports 3580 and inclusion of some or all of the third set of weight portions 3520 and the fourth set of weight portions 3540 in the weight ports 3560 and 3580 may affect the sound and feel of the golf club head to an individual using the golf club to strike a ball. Furthermore, the locations of third set of weight ports 3560 and the fourth set of weight ports 3580 and inclusion of some or all of the third set of weight portions 3520 and the fourth set of weight portions 3540 in the weight ports 3560 and 3580 may affect the total weight and the location of the center of gravity of the golf club head. Accordingly, the sound, feel, weight and center of gravity location of the golf club head may be adjustable to provide a particular sound, feel, weight and/or swing characteristics for an individual. The third set of weight ports 3560 and the fourth set of weight ports 3580 may be configured on the back wall portion 3550 between the top portion 3370 and the bottom portion 3380. The weight ports of the third set of weight ports 3560 extend between the toe portion 3330 and the heel portion 3340, and the weight ports of the fourth set of weight ports 3580 extend between the toe portion 3330 and the heel portion 3340. The weight ports of the third set of weight ports 3560 may be aligned substantially linearly and extend between the toe portion 3330 and the heel portion 3340. Alternatively, the weight ports of the third set of weight ports 3560 may be aligned and extend between the toe portion 3330 and the toe portion 3340 according to a contour of the top portion 3370 or the bottom portion 3380. Further, the weight ports of the third set of weight ports 3560 may extend between the toe portion 3330 and the heel portion 3340 in any configuration. The weight ports of the fourth set of weight ports 3580 may be aligned substantially linearly and extend between the toe portion 3330 and the heel portion 3340. Alternatively, the weight ports of the fourth set of weight ports 3580 may be aligned and extend between the toe portion 3330 and the heel portion 3340 according to a contour of the top portion 3370 or the bottom portion 3380. Further, the weight ports of the fourth set of weight ports 3580 may extend between the toe portion 3330 and the heel portion 3340 in any configuration. In one example, the first set of weight ports 3560 and the second set of weight ports 3580 may appear as substantially parallel rows of weight ports extending between the toe portion 3330 and the heel portion 3340.

Each of the weight ports of the third set of weight ports 3560 may be above and staggered relative to adjacent weight ports of the fourth set of weight ports 3580. Each of the weight ports of the fourth set of weight ports 3580 may be below and staggered relative to adjacent weight ports of the third set of weight ports 3560. In one example, the weight ports of the third set of weight ports 3560 and the weight ports of the fourth set of weight ports 3580 may be generally aligned in a vertical direction (i.e., not staggered, not shown). The third and fourth sets of weight portions 3520 and 3540, respectively, may be partially or entirely made of a high-density material such as a tungsten-based material or suitable types of materials. Alternatively, the third and fourth sets of weight portions 3520 and 3540, respectively, may be partially or entirely made of a non-metal material (e.g., composite, plastic, etc.). The apparatus, methods, and articles of manufacture described herein are not limited in this regard.

The weight portions of each of the first, second, third and fourth sets of weight portions 3420, 3440, 3520 and 3540, respectively, may have similar or different physical properties (e.g., density, shape, mass, volume, size, color, etc.). For example, the weight portions of the third set of weight portions 3520 may have the same properties, while the weight portions of the fourth set of weight portions 3540 may have the same properties but different properties than the weight portions of the third set of weight portions 3520. In another example, the weight portions of the third set of weight portions 3520 may have different properties and/or the weight portions of the fourth set of weight portions 3540 may have different properties. In the illustrated example as shown in FIGS. 25-27, each of the weight portions of the third and fourth sets 3520 and 3540 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

The third and fourth sets of weight portions 3520 and 3540, respectively, may include threads to secure in the weight ports of the third set of weight ports 3560 and the fourth set of weight ports 3580, which may also have corresponding threads. The third and fourth sets of weight portions 3520 and 3540, respectively, may include threads to secure in the weight ports of the first set of weight ports 3460 and the second set of weight ports 3480, which may also have corresponding threads. For example, each weight portion of the third and fourth sets of weight portions 3520 and 3540, respectively, may be a screw. The third and fourth sets of weight portions 3520 and 3540, respectively, may not be readily removable from the body portion 3310 with or without a tool. Alternatively, the third and fourth sets of weight portions 3520 and 3540, respectively, may be readily removable (e.g., with a tool) so that a relatively heavier or lighter weight portion may replace one or more of the weight portions of the third and fourth sets 3520 and 3540, respectively. In another example, the third and fourth sets of weight portions 3520 and 3540, respectively, may be secured in the weight ports of the third set of weight ports 3560 and the fourth set of weight ports 3580 with epoxy or adhesive so that the third and fourth sets of weight portions 3520 and 3540, respectively, may not be readily removable. In yet another example, the third and fourth sets of weight portions 3520 and 3540, respectively, may be secured in the weight ports of the third set of weight ports 3560 and the fourth set of weight ports 3580 with both epoxy and threads so that the third and fourth sets of weight portions 3520 and 3540, respectively, may not be readily removable.

Each weight port of the first set of weight ports 3460 may have a first port diameter ($PD_1$). In particular, a uniform distance of less than the first port diameter may separate any two adjacent weight ports of the first set 3460 (e.g., (i) weight ports 3461 and 3462, and (ii) weight ports 3462 and 3463). In one example, the first port diameter may be about 0.25 inch and any two adjacent weight ports of the first set 3460 may be separated by 0.1 inch.

In a similar manner, each weight port of the second set of weight ports 3480 may have a second port diameter ($PD_2$). A uniform distance of less than the second port diameter may separate any two adjacent weight ports of the second set 3480 (e.g., (i) weight ports 3481 and 3482, and (ii) weight ports 3482 and 3483). For example, the second port diameter may be about 0.25 inch and any two adjacent weight ports of the second set 3480 may be separated by 0.1 inch.

In a similar manner, each weight port of the third set of weight ports 3560 may have a third port diameter ($PD_3$). A uniform distance of less than the third port diameter may separate any two adjacent weight ports of the third set 3560 (e.g., (i) weight ports 3561 and 3562, (ii) weight ports 3562 and 3563, (iii) weight ports 3563 and 3564, or (iv) weight ports 3564 and 3565). For example, the third port diameter may be about 0.25 inch and any two adjacent weight ports of the third set 3560 may be separated by 0.1 inch.

In a similar manner, each weight port of the fourth set of weight ports 3580 may have a fourth port diameter ($PD_4$). A uniform distance of less than the fourth port diameter may separate any two adjacent weight ports of the fourth set 3580 (e.g., (i) weight ports 3581 and 3582, (ii) weight ports 3582 and 3583, (iii) weight ports 3583 and 3584, (iv) weight ports 3584 and 3585, or (v) weight ports 3585 and 3586). For example, the fourth port diameter may be about 0.25 inch and any two adjacent weight ports of the fourth set 3580 may be separated by 0.1 inch.

Any two or more of the first, second, third, and fourth port diameters may be generally equal to each other (e.g., $PD_1=PD_2=PD_3=PD_4$) or not equal to each other (e.g., $PD_1=PD_2=PD_3\neq PD_4$). The apparatus, methods, and articles of manufacture described herein are not limited in this regard.

A uniform distance of less than the third port diameter or the fourth port diameter may separate any two adjacent weight ports of the third set 3560 and the fourth set 3580 (e.g., (i) weight ports 3581 and 3561, (ii) weight ports 3561 and 3582, (iii) weight ports 3582 and 3562, (iv) weight ports 3562 and 3583, (v) weight ports 3583 and 3563, (vi) weight ports 3563 and 3584, (vii) weight ports 3584 and 3564, (viii) weight ports 3564 and 3585, (ix) weight ports 3585 and 3565, or (x) weight ports 3565 and 3586). The weight portions of the first set of weight portions 3420, the second set of weight portions 3440, the third set of weight portions 3520, and the fourth set of weight portions 3540 may be used in any of the weight ports of the first set of weight ports 3402, the second set of weight ports 3404, the third set of weight ports 3560 and the fourth set of weight ports 3580. The apparatus, methods, and articles of manufacture described herein are not limited in this regard.

The weight portions of the first set 3420, the second set 3440, third set 3520, and the fourth set 3540 may be interchangeable with other weight portions having different mass configurations so that the center of gravity, moment of inertia and/or other weight and inertia characteristics of the golf club may be adjusted. For example, the overall mass of the first set of weight portions 3420 may be greater than the overall mass of the second set of weight portions 3440 to provide a toe-weighted bias for the golf club head 3340. In another example, the overall mass of fourth set of weight portions 3540 may be greater than or less than the overall mass of the third set of weight portions 3520 to position the center of gravity of the golf club head 3340 lower or higher, respectively. The fourth set of weight ports 3180 may have a greater number of weight ports than the third set of weight ports 3560. Accordingly, when the weight portions of the third set of weight portions 3520 and the weight portions of the fourth set of weight portions 3540 have the same mass, the overall mass of the fourth set of weight portions 3540 is greater than the overall mass of the third set of weight portions 3520. In one example, some or all of the weight portions of the third set of weight portions 3520 may have a greater mass than some of all of the weight portions of the fourth set of weight portions 3540 so that the overall mass of the third set of weight portions 3520 is greater than the overall mass of the fourth set of weight portions 3540. The third set of weight portions 3520 and the fourth set of weight portions 3540 may have the same mass. In another example, the weight portions of the third and fourth set of weight portions 3520 and 3540, respectively, that are near the toe portion 3330 may have a greater overall mass that the weight portions of the third and fourth set of weight portions 3520 and 3540, respectively, that are near the heel portion 3340 so that the overall mass of the third and fourth set of weight portions 3520 and 3540, respectively, near the toe portion 3330 is greater than the overall mass near the heel portion 3340. In another example, the weight portions of the third and fourth set of weight portions 3520 and 3540, respectively, that are near the heel portion 3340 may have a greater overall mass that the weight portions of the third and fourth set of weight portions 3520 and 3540, respectively, that are near the toe portion 3330 so that the overall mass of the third and fourth set of weight portions 3520 and 3540, respectively, near the heel portion 3340 is greater than the overall mass near the toe portion 3330. Thus, the weight portions of the third set of weight portions 3520 and the fourth set of weight portions 3540 can be configured so as to adjust and provide a particular location for the center of gravity of the golf club head 3540. Thus, the weight portions of the golf club head 3340 may be configured in any manner to provide a particular configuration of the golf club head 3340.

Figure 41:
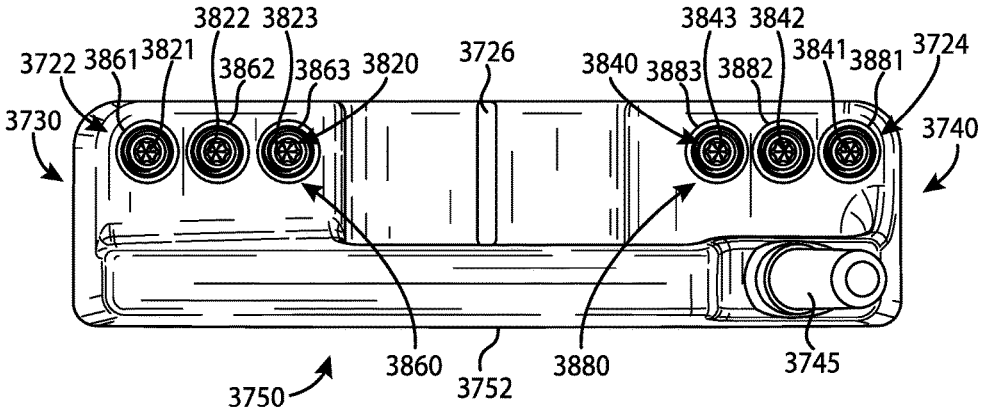
FIG. 41 depicts a top view of the example golf club head of FIG. 37.
Figure 42:
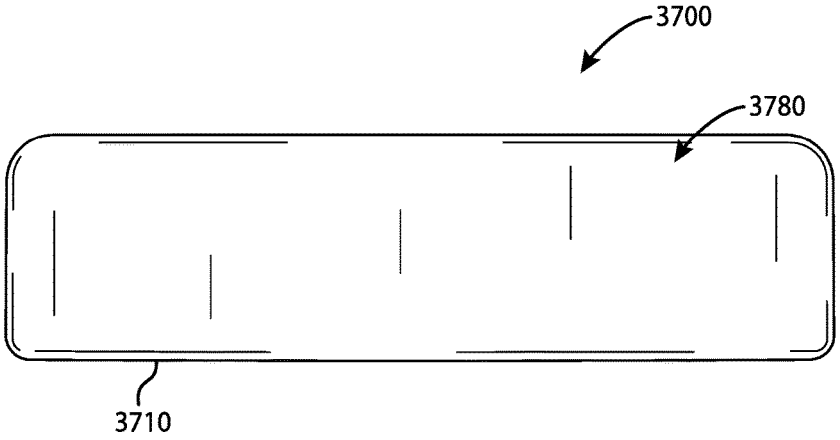
FIG. 42 depicts a bottom view of the example golf club head of FIG. 37.

Turning to FIGS. 37-44, for example, a blade-type putter club head 3700 may include a body portion 3710 with a toe portion 3730, a heel portion 3740, a front portion 3750 with a face portion 3752 (e.g., a strike face), which may be used to impact a golf ball (one shown as 500 in FIG. 5), a rear portion 3760, a top portion 3770, a bottom portion 3780, and a back wall portion 3950, which is located opposite the face portion 3752 between the face portion 3752 and a back end 3761 of the rear portion 3760. As shown in FIG. 41, the body portion 3710 may also include one or more visual guide portions, generally shown as 3722, 3724, and 3726. The visual guide portions 3722 and 3724 may be defined by a first set of weight portions 3820 (e.g., shown as 3821, 3822, and 3823) and a second set of weight portions 3840 (e.g., shown as 3841, 3842, and 3843) configured to engage a first set of weight ports 3860 (e.g., shown as 3861, 3862 and 3863) and the second set of weight ports 3880 (e.g., show as 3881, 3882, and 3883). The visual guide portions 3722, 3724 and 3726 may be similar in many respects to the visual guide portions 3322, 3324 and 3326, respectively, of the golf club head 3300. Furthermore, the weight portions 3820 and 3840 and the weight ports 3860 and 3880 may be similar in many respects to the weight portions 3420 and 3440 and the weight ports 3460 and 3480, respectively, of the golf club head 3300. Further yet, the golf club head 3700 may include any other visual guide portions, weight portions and/or weight ports that may be similar to any of the golf club heads described herein. For example, the golf club head 3700 may include a third set and/or a fourth set of weight portions and/or weight ports on the back wall portion 3950 similar to the golf club head 3300. The apparatus, methods, and articles of manufacture described herein are not limited in this regard.

The body portion 3710 may also include a hosel portion (not shown) to receive a shaft 3746. Alternatively, as shown in FIGS. 37-44, the body portion 3710 may directly receive the shaft 3746. The body portion 3710 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 3710 may be partially or entirely made of a non-metal material (e.g., composite, plastic, etc.). The apparatus, methods, and articles of manufacture described herein are not limited in this regard.

A portion of the body portion 3710 between the toe portion 3730 and the heel portion 3740 may be defined as a center portion 3735 of the body portion 3710. A center portion 3735 may be defined by a portion of the body portion 3710 that includes a geometric vertical center line 4035 of the face portion 3752. The center portion 3735 may extend vertically from the top portion 3770 to the bottom portion 3780 and horizontally from a toe-side boundary line 4031 to a heel-side boundary line 4041. The toe-side boundary line 4031 and the heel-side boundary line 4041 may be equidistant from the center line 4035. Alternatively, the toe-side boundary line 4031 and the heel-side boundary line 4041 may not have a similar distances to the center line 4035. In one example, the distance between the toe-side boundary line 4031 and a heel-side boundary line 4041 may be around 25% of the largest horizontal dimension of the body portion 3710. In another example, the distance between the toe-side boundary line 4031 and a heel-side boundary line 4041 may be around 25%-40% of the largest horizontal dimension of the body portion 3710. In yet another example, the distance between the toe-side boundary line 4031 and a heel-side boundary line 4041 may be around 40%-50% of the largest horizontal dimension of the body portion 3710. In yet another example, the distance between the toe-side boundary line 4031 and a heel-side boundary line 4041 may be similar to a diameter of a golf ball. Although the toe-side boundary line 4031 and the heel-side boundary line 4041 are diagrammatically shown and discussed as lines, each of the toe-side boundary line 4031 and the heel-side boundary line 4041 may represent a boundary region. The apparatus, methods, and articles of manufacture described herein are not limited in this regard.

Figure 43:
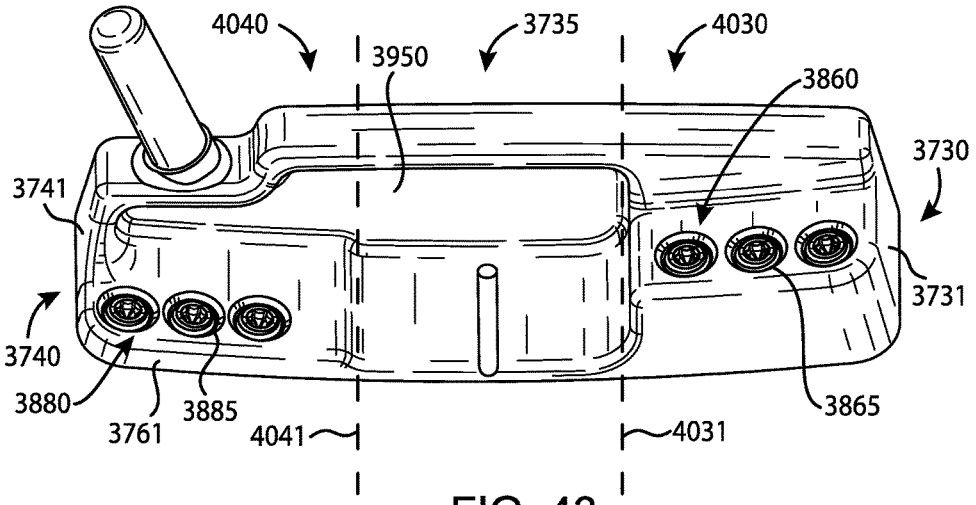
FIG. 43 depicts a top-rear perspective view of the example golf club head of FIG. 37.
Figure 44:
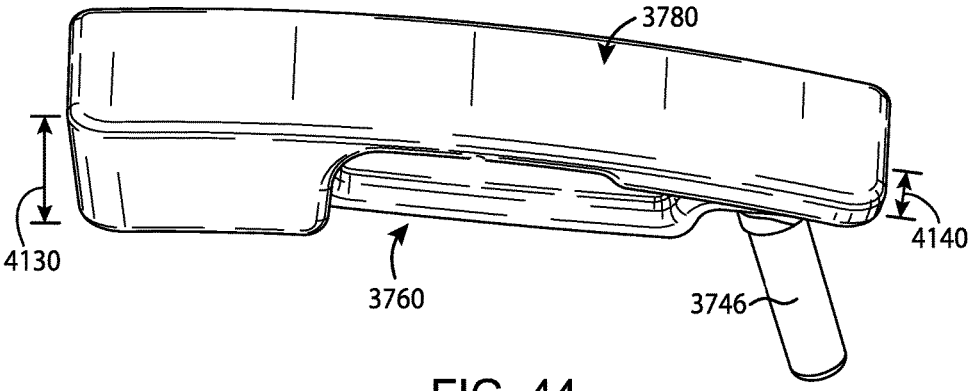
FIG. 44 depicts a bottom-rear perspective view of the example golf club head of FIG. 37.

A portion of the body portion 3710 between the center portion 3735 and an outer edge 3731 of the toe portion 3730 may be defined as a toe-side body portion 4030. In the example of FIG. 43, a boundary between the center portion 3735 and the toe-side body portion 4030 is shown by the toe-side boundary line 4031. However, the toe-side boundary line 4031 may be at any location between a center line 4035 of the face portion 3752 (shown in FIG. 37) and the outer edge 3731 of the toe portion 3730. Further, the boundary between the center portion 3735 and the toe-side body portion 4030 may be defined by a region between and/or overlapping the center portion 3735 and the toe-side body portion 4030. A portion of the body portion 3710 between the center portion 3735 and an outer edge 3741 of the heel portion 3740 may be defined as a heel-side body portion 4040. In the example of FIG. 43, a boundary between the center portion 3735 and the heel-side body portion 4040 is shown by the heel-side boundary line 4041. However, the heel-side boundary line 4041 may be at any location between the center line 4035 and the outer edge 3741 of the heel portion 3740. Further, the boundary between the center portion 3735 and the heel-side body portion 4040 may be defined by a region between and/or overlapping the center portion 3735 and the heel-side body portion 4040. The center portion 3735 may be defined as the portion of the body portion 3710 between the boundary lines 4031 and 4041. The apparatus, methods, and articles of manufacture described herein are not limited in this regard.

In one example shown in FIGS. 37-44, the mass of the toe-side body portion 4030 may be greater than the mass of the heel-side body portion 4040. In one example, the mass of the toe-side body portion 4030 may be greater than the mass of the heel-side body portion 4040 by 5% to 15%. In one example, the mass of the toe-side body portion 4030 may be greater than the mass of the heel-side body portion 4040 by 10% to 25%. In one example, the mass of the toe-side body portion 4030 may be greater than the mass of the heel-side body portion 4040 by 15% to 50%. In one example, the mass of the toe-side body portion 4030 may be greater than the mass of the heel-side body portion 4040 by 50% or more. By having a greater mass of the body portion 3710 between the center line 4035 and the outer edge 3731 of the toe portion 3730, a center of gravity (CG) 4045 of the golf club head 3700 may be located between the center line 4035 and the toe portion 3730. Accordingly, a moment of inertia (MOI) of the golf club head about a shaft axis 4050 may be increased. Increasing the MOI about the shaft axis 4050 may increase resistance of the golf club head 3700 to twisting when an individual swings a golf club. Accordingly, the individual may be able to better maintain an alignment of the face portion 3752 when striking a golf ball. The apparatus, methods, and articles of manufacture described herein are not limited in this regard.

The mass of the toe-side body portion 4030 may be greater than the mass of the heel-side body portion 4040 by the toe-side height 4130 (Ht) of the toe-side body portion 4030 between the back wall portion 3950 and the back end 3761 of the rear portion 3760 being greater than the heel-side height 4140 (Hh) of the heel-side body portion 4040 between the back wall portion 3950 and the back end 3761 of the rear portion 3760. In other words, a greater mass of the body portion 3710 may be located at or proximate to the toe portion 3730 relative to the heel portion 3740 to increase the MOI of the golf club head 3700 as described. In one example, the toe-side height 4130 may be greater than the heel-side height 4140 by 5% to 15%. In one example, the toe-side height 4130 may be greater than the heel-side height 4140 by 10% to 25%. In one example, the toe-side height 4130 may be greater than the heel-side height 4140 by 15% to 50%. In one example, the toe-side height 4130 may be greater than the heel-side height 4140 by 50% or more. The apparatus, methods, and articles of manufacture described herein are not limited in this regard.

The weight ports of the first set of weight ports 3860 may be located on the toe-side body portion 4030 between the back wall portion 3950 and the back end 3761 of the rear portion 3760. Each weight port of the first set of weight ports 3860 may extend from an opening (e.g., one opening generally shown as 3865 in FIG. 43) on the top portion 3770 toward the bottom portion 3780. The weight ports of the second set of weight ports 3880 may be located on the heel-side body portion 4040 between the back wall portion 3950 and the back end 3761 of the rear portion 3760. Each weight port of the second set of weight ports 3880 may extend from an opening (e.g., one opening generally shown as 3885 in FIG. 43) on the top portion 3770 toward the bottom portion 3780. Each weight port of the first set of weight ports 3860 and the second set of weight ports 3880 may be similar to many respects to the weight ports described herein. Further, the distance between adjacent weight ports of the first set of weight ports 3860 and/or the distance between adjacent weight ports of the second set of weight ports 3880 may be similar in many respect to any distance between adjacent weight ports described herein. The apparatus, methods, and articles of manufacture described herein are not limited in this regard.

The weight portions of the first set of weight portions 3820 and the second set of weight portions 3840 may be interchangeable with each other and/or with other weight portions having different mass configurations so that the center of gravity, moment of inertia and/or other weight and inertia characteristics of the golf club head 3700 may be adjusted. For example, the overall mass of the first set of weight portions 3820 may be greater than the overall mass of the second set of weight portions 3840. In another example, the overall mass of the second set of weight portions 3840 may be greater than the overall mass of the first set of weight portions 3820. Thus, mass differences between the weight portions of the first set of weight portions 3820 and the second set of weight portions 3840 may provide further and more granular adjustments of the difference between the mass of the toe-side body portion 4030 and the mass of the heel-side body portion 4040 for a finer adjustment of the MOI of the golf club head 3700 as described herein. The apparatus, methods, and articles of manufacture described herein are not limited in this regard.

Figure 37:
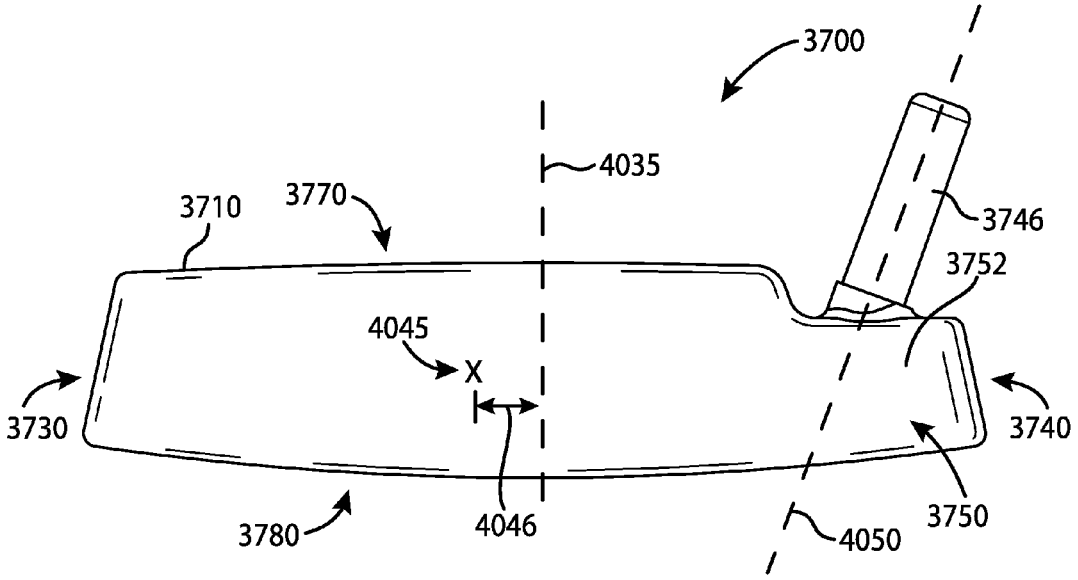
FIG. 37 depicts a front view of a golf club head according to another embodiment of the apparatus, methods, and articles of manufacture described herein.
Figure 38:
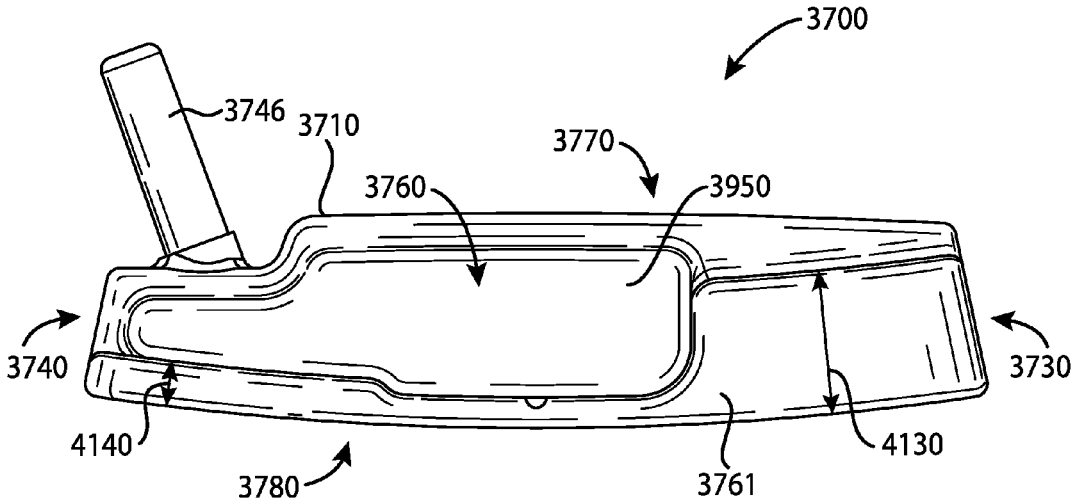
FIG. 38 depicts a rear view of the example golf club head of FIG. 37.
Figure 39:
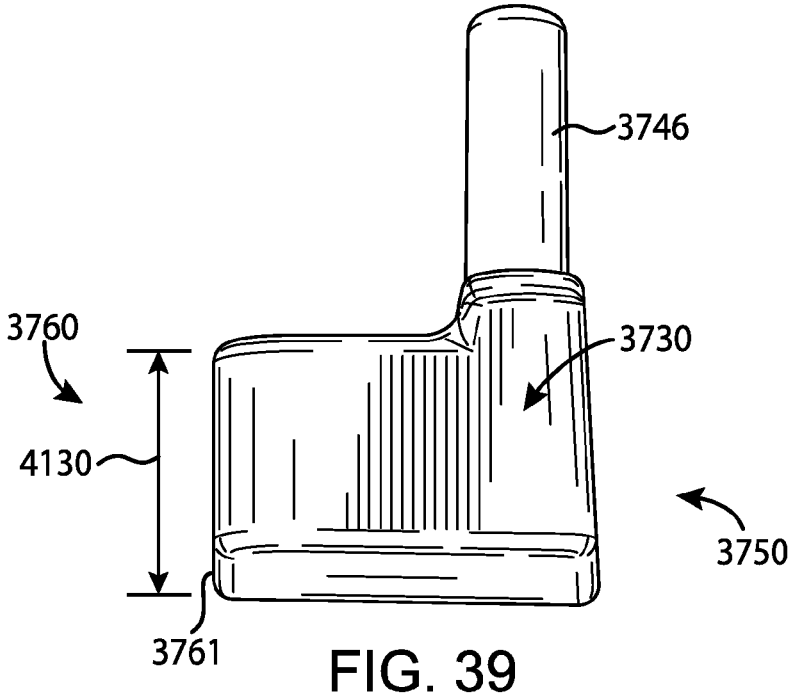
FIG. 39 depicts a toe view of the example golf club head of FIG. 37.
Figure 40:
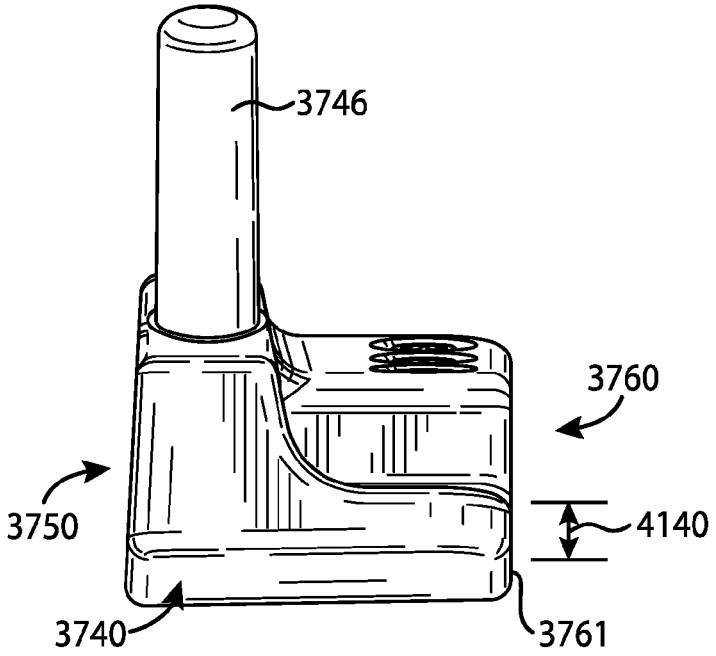
FIG. 40 depicts a heel view of the example golf club head of FIG. 37.

In one example shown in FIG. 37, the CG 4045 may be offset relative to the center line 4035 depending on the difference between the mass of the toe-side body portion 4030 and the heel-side body portion 4040 as described herein. In one example, the distance 4046 between the CG 4045 and the center line 4035 may be between about 0.1 inch (0.254 cm) and about 0.5 inch (1.27 cm). In one example, the distance 4046 between the CG 4045 and the center line 4035 may be between about 0.2 inch (0.508 cm) and about 0.4 inch (1.106 cm). In one example, the distance 4046 between the CG 4045 and the center line 4035 may be between about 0.15 inch (0.381 cm) and about 0.65 inch (1.651 cm). The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a toe portion, a heel portion, a center portion between the toe portion and the heel portion, a front portion with a strike face, a rear portion having a back end, a sole portion, a top portion, and a back wall portion between the strike face and the back end of the rear portion; and a plurality of ports, each port having an opening on the top portion and extending into the body portion from the opening toward the sole portion, the plurality of ports comprising a first set of ports and a second set of ports, the first set of ports being proximate to the toe portion and extending between the toe portion and the heel portion, the second set of ports being proximate to the heel portion and extending between the toe portion and the heel portion, wherein a height of the body portion between the center portion and the toe portion and between the back wall portion and the back end of the rear portion is greater than a height of the body portion between the center portion and the heel portion and between the back wall portion and the back end of the rear portion such that the mass of the toe portion is greater than a mass of the heel portion.

2. A golf club head as defined in claim 1, wherein the plurality of ports is located less than or equal to 0.5 inch from a periphery of the body portion at or proximate to the rear portion.

3. A golf club head as defined in claim 1, further comprising a plurality of weight portions with each weight portion disposed in one port of the plurality of ports.

4. A golf club head as defined in claim 1, further comprising a plurality of weight portions having a first set of weight portions and a second set of weight portions, wherein an overall mass of the second set of weight portions is different than an overall mass of the first set of weight portions, wherein each weight portion of the second set of weight portions is disposed in a port of the second set of ports, and wherein each weight portion of the first set of weight portions is disposed in a port of the first set of ports.

5. A golf club head as defined in claim 1, wherein the first set of ports and the second set of ports are separated by a distance greater than or equal to a diameter of a golf ball.

6. A golf club head as defined in claim 1, wherein the back wall portion comprises at least one port extending in a direction from the back wall portion to the front portion.

7. A golf club head as defined in claim 1, further comprising a visual guide portion extending between the front portion and the rear portion, the visual guide portion being substantially equidistant relative to the first set of ports and the second set of ports.

8. A golf club head comprising:

a plurality of weight portions;

a body portion having a toe portion, a heel portion, a front portion with a strike face, a rear portion, a sole portion, and a top portion; and a plurality of ports comprising a first set of ports and a second set of ports, the first set of ports extending from a location proximate to the toe portion toward the heel portion, the second set of ports extending from a location proximate to the heel portion toward the toe portion, each port of the plurality of ports configured to receive a weight portion of the plurality of weight portions, wherein a mass of the body portion at or proximate to the toe portion is greater than a mass of the body portion at or proximate to the heel portion such that a center of gravity of the golf club head is between a vertical center line of the body portion and the toe portion, and wherein a height of the body portion at or proximate to the toe portion is greater than a height of the body portion at or proximate to the heel portion such that the mass of the body portion at or proximate to the toe portion is greater than the mass of the body portion at or proximate to the heel portion.

9. A golf club head as defined in claim 8, wherein the mass of the body portion at or proximate to the toe portion is greater than the mass of the body portion at or proximate to the heel portion by one of (i) 5% to 15% more, (ii) 10% to 25% more, (iii) 15% to 50% more, or (iv) 50% more.

10. A golf club head as defined in claim 8, wherein the plurality of weight portions comprises a first set of weight portions and a second set of weight portions, wherein an overall mass of the second set of weight portions is different than an overall mass of the first set of weight portions, wherein each weight portion of the second set of weight portions is disposed in a port of the second set of ports, and wherein each weight portion of the first set of weight portions is disposed in a port of the first set of ports.

11. A golf club head as defined in claim 8, wherein the body portion comprises a back wall portion having at least one port extending in a direction from the back wall portion to the front portion.

12. A golf club head comprising:

a plurality of weight portions;

a body portion having a toe portion, a heel portion, a front portion with a strike face, a rear portion, a sole portion, and a top portion; and a plurality of ports comprising a first set of ports and a second set of ports, the first set of ports extending from a location proximate to the toe portion toward the heel portion, the second set of ports extending from a location proximate to the heel portion toward the toe portion, each port of the plurality of ports configured to receive a weight portion of the plurality of weight portions, wherein a mass of the body portion at or proximate to the toe portion is greater than a mass of the body portion at or proximate to the heel portion such that a center of gravity of the golf club head is between a vertical center line of the body portion and the toe portion, and wherein the plurality of ports is located less than or equal to 0.5 inch from a periphery of the body portion at or proximate to the rear portion.

13. A golf club head comprising:

a plurality of weight portions;

a body portion having a toe portion, a heel portion, a front portion with a strike face, a rear portion, a sole portion, and a top portion; and a plurality of ports comprising a first set of ports and a second set of ports, the first set of ports extending from a location proximate to the toe portion toward the heel portion, the second set of ports extending from a location proximate to the heel portion toward the toe portion, each port of the plurality of ports configured to receive a weight portion of the plurality of weight portions, wherein a mass of the body portion at or proximate to the toe portion is greater than a mass of the body portion at or proximate to the heel portion such that a center of gravity of the golf club head is between a vertical center line of the body portion and the toe portion, and wherein at least one port of the first set of ports is located less than or equal to 0.5 inch from a periphery of the body portion at or proximate to the toe portion and at least one port of the second set of ports is located less than or equal to 0.5 inch from the periphery of the body portion at or proximate to the heel portion.

14. A golf club head comprising:

a plurality of weight portions;

a body portion having a toe portion, a heel portion, a front portion with a strike face, a rear portion, a sole portion, and a top portion; and a plurality of ports comprising a first set of ports and a second set of ports, the first set of ports extending from a location proximate to the toe portion toward the heel portion, the second set of ports extending from a location proximate to the heel portion toward the toe portion, each port of the plurality of ports configured to receive a weight portion of the plurality of weight portions, wherein a mass of the body portion at or proximate to the toe portion is greater than a mass of the body portion at or proximate to the heel portion such that a center of gravity of the golf club head is between a vertical center line of the body portion and the toe portion, and wherein the first set of ports and the second set of ports are separated by a distance greater than or equal to a diameter of a golf ball.

15. A golf club head comprising:

a body portion having a toe portion, a heel portion, a center portion between the toe portion and the heel portion, a front portion with a strike face, a rear portion having a back end, a sole portion, a top portion, and a back wall portion between the strike face the back end of the rear portion, wherein a distance between the bottom portion and the top portion at or proximate to the toe portion and between the back wall portion and the back end of the rear portion is at least about 25% greater than a distance between the bottom portion and the top portion at or proximate to the heel portion and between the back wall portion and the back end of the rear portion such that a mass of the body portion between a vertical center line of the body portion and the toe portion is greater than a mass of the body portion between a vertical center line of the body portion and the heel portion.

16. A golf club head as defined in claim 15, further comprising:

a plurality of ports comprising a first set of ports extending in a direction from the toe portion to the heel portion and a second set of ports extending in a direction from the heel portion to the toe portion;

wherein at least one port of the first set of ports is located less than or equal to 0.5 inch from a periphery of the body portion at or proximate to the toe portion;

wherein at least one port of the second set of ports is located less than or equal to 0.5 inch from the periphery of the body portion at or proximate to the heel portion;

wherein adjacent ports of the first set of ports are separated by a distance less than or equal to a port diameter of any of the ports of the first set of ports;

wherein adjacent ports of the second set of ports are separated by a distance less than or equal to a port diameter of any of the ports of the second set of ports, and wherein the first set of ports and the second set of ports are separated by a distance greater than or equal to one inch.

17. A golf club head as defined in claim 15 further comprising:

a plurality of ports on the top portion, the plurality of ports comprising a first set of ports and a second set of ports;

a plurality of weight portions having a first set of weight portions and a second set of weight portions;

wherein each weight portion of the second set of weight portions is disposed in a port of the second set of ports, and wherein each weight portion of the first set of weight portions is disposed in a port of the first set of ports.

18. A golf club head as defined in claim 15, further comprising a plurality of ports on the top portion, the plurality of ports comprising a first set of ports and a second set of ports, wherein each port of the plurality of ports extends from an opening on the top portion toward the bottom portion.

19. A golf club head as defined in claim 15, further comprising a plurality of ports on the top portion, the plurality of ports comprising a first set of ports and a second set of ports, wherein the first set of ports and the second set of ports are separated by a distance greater than or equal to a diameter of a golf ball.

20. A golf club head as defined in claim 15, wherein the rear portion comprises a back wall portion having at least one port extending in a direction from the back wall portion to the front portion.

* * * * *